US010308262B2

(12) United States Patent
Westman et al.

(10) Patent No.: US 10,308,262 B2
(45) Date of Patent: Jun. 4, 2019

(54) BEARING BRACKET, ASSEMBLY CONTAINING SUCH A BEARING BRACKET AND SYSTEM CONTAINING SUCH AN ASSEMBLY

(71) Applicant: Dellner Couplers AB, Falun (SE)

(72) Inventors: Anders Westman, Falun (SE); Fredrik Hedh, Avesta (SE); Thilo Koch, Hamburg (DE)

(73) Assignee: Dellner Couplers AB, Falun (SE)

( * ) Notice: Subject to any disclaimer, the term of this patent is extended or adjusted under 35 U.S.C. 154(b) by 236 days.

(21) Appl. No.: 15/107,813

(22) PCT Filed: Dec. 16, 2014

(86) PCT No.: PCT/EP2014/003382

§ 371 (c)(1),
(2) Date: Jun. 23, 2016

(87) PCT Pub. No.: WO2015/096893

PCT Pub. Date: Jul. 2, 2015

(65) Prior Publication Data

US 2016/0318528 A1 Nov. 3, 2016

(30) Foreign Application Priority Data

Dec. 23, 2013 (EP) ..... 13006006
Mar. 25, 2014 (EP) ..... 14001090

(51) Int. Cl.
*B61G 1/18* (2006.01)
*B61G 9/24* (2006.01)
*B61G 11/16* (2006.01)

(52) U.S. Cl.
CPC ..... *B61G 1/18* (2013.01); *B61G 9/24* (2013.01); *B61G 11/16* (2013.01)

(58) Field of Classification Search
CPC ... B61G 1/00; B61G 1/02; B61G 1/10; B61G 1/18; B61G 1/20; B61G 1/28; B61G 1/40
See application file for complete search history.

(56) References Cited

U.S. PATENT DOCUMENTS

2009/0151595 A1 6/2009 Kontetzki

FOREIGN PATENT DOCUMENTS

EP 1407953 A1 4/2004
EP 1719684 A1 11/2006
(Continued)

OTHER PUBLICATIONS

Intl. Search Report and Written Opinion cited in PCT/EP2014/003382 dated Apr. 14, 2015.

*Primary Examiner* — Robert J McCarry, Jr.
(74) *Attorney, Agent, or Firm* — Howard IP Law Group

(57) ABSTRACT

An assembly has a bearing bracket and a coupler or connection rod. The bearing bracket has an adapter to which the rod can be connected. A joint allows the adapter to swivel relative to the bracket, and the rod is attached to the adapter. The rod has a surface that extends in a plane at an angle relative to the longitudinal axis of the rod. The rod surface is held spaced apart from a surface of the bearing bracket by an elastic element. The surface of the rod contacts the surface of the bearing bracket, if a pushing force of a predetermined strength is applied to the rod. A group of parts of the bearing bracket are connected to the bracket such that the parts are set free to move relative to the bracket, if a pushing force of a predetermined strength is applied to the rod.

17 Claims, 13 Drawing Sheets

(56) References Cited

FOREIGN PATENT DOCUMENTS

| | | | | | |
|---|---|---|---|---|---|
| EP | 1312527 | B1 | | 8/2007 | |
| EP | 1857342 | A1 | | 11/2007 | |
| EP | 1925523 | | * | 5/2008 | ..... B61G 5/02 |
| EP | 1925523 | A1 | | 5/2008 | |
| WO | 2005/023618 | A1 | | 3/2005 | |

* cited by examiner

BEARING BRACKET, ASSEMBLY CONTAINING SUCH A BEARING BRACKET AND SYSTEM CONTAINING SUCH AN ASSEMBLY

CROSS-REFERENCE TO RELATED APPLICATIONS

This application is a national phase application under 35 U.S.C. § 371 of International Patent Application No. PCT/EP2014/003382 filed Dec. 16, 2014, which claims priority to European Applications 13 006 006.4 filed Dec. 23, 2013 and 14 001 090.1 filed Mar. 25, 2014, all of which are incorporated herein by reference in their entirety for all purposes.

FIELD OF INVENTION

The invention relates to a bearing bracket, an assembly containing such a bearing bracket, a system containing such an assembly and a multi-car vehicle.

BACKGROUND

Multi-car vehicles are known in different designs and in different forms of adaptation for uses. Multi-car vehicles, for example, railway-bound trains (streetcars and subway-trains also being considered as such trains) are known and are known for the purpose of transporting passengers as well as transporting goods. Further types of multi-car vehicles can be magnetic railway-trains or can be busses (road busses as well as busses traveling on fixed tracks). A car of a multi-car vehicle can be a self-supporting car, whereby the car has sufficient wheels that are placed at sufficient locations such that the car can stand by itself without being supported by other cars, for example, a three-wheeled car, a four-wheeled car or a car with even more wheels placed at suitable locations. A car of a multi-car vehicle can also be of the non-self-supporting type, whereby the car has no wheels or only wheels provided in such number or arranged at such a place that the car cannot stand by itself, but is vertically supported by at least one neighboring car.

To form the multi-car vehicles, the individual cars of the vehicle are connected to one another by means of a connecting device. The connecting device can be provided for different types of purposes. In multi-car vehicles where only one or only several of the total of cars is driven, the connecting devices are provided so that the driven car can drive the non-driven car and thus ensures that the complete vehicle travels with the same speed. Connecting devices are also distinguished between those connecting devices that allow for an easy decoupling of the cars, whereby easy decoupling is understood to be accomplished within a couple of minutes, or for what is called "semi-permanent" coupling of cars, for which decoupling of the cars takes efforts and usually involves the vehicle to have been transported to a specific workshop. Trains, for example, can have coupler-heads as a part of their connecting devices. These coupler-heads can, for example, be so-called "automatic couplers" that allow decoupling within minutes.

From EP 1 719 684 a bearing bracket (called "Lagerbock" in EP 1 719 684 B1) of a central buffer coupling is known that is suitable to connect a coupler rod ("Kupplungsschaft" in EP 1 719 684 B1) to a car. The coupler rod is arranged to pass through a housing and is connecting to said housing by elastic members arranged at the outside of the coupling rod and held inside the housing. The housing is connected to a bracket by means of a top-pivot pin and a bottom-pivot pin that allow the housing to swivel relative to the bracket about a vertical swivel axis. Arranged between the housing and the top-swivel pin and the bottom-swivel pin are shear-off elements. If the coupling rod is pushed along its longitudinal axis with a pushing force of a predetermined magnitude, the shear-off elements will set the housing free with respect to the bracket and will allow the coupling rod and the housing to move relative to the bracket in unison. The design known from EP 1 719 684 B1 is disadvantageous, because of the work necessary to make the known bearing bracket fit for further use after the shear-off elements have sheared off.

Form EP 1 312 527 B1 an articulated arrangement for a multi-car vehicle is known that comprises a first articulated arm and a second articulated arm, which cooperate in an articulated manner by means of a bearing. An energy dissipating member is integrated into one of the articulated arms. This articulation is achieved by giving the respective joint arm a basic body with horizontal and vertical flanges arranged at this basic body. A profile 9 that forms part of the joint arm is arranged to glide along guides arranged inside the basic body. Also arranged inside the basic body is a deformation tube that is held at one end by a pressure plate that closes the hollow space inside the basic body, in which the deformation tube and the profile are arranged. The deformation tube on its other side is held by the profile. The basic body, the pressure plate, the deformation tube and the profile jointly form the articulated arm. The unit of pieces that is thus created is connected to the car as one unit and held to the car by means of the flanges of the basic body. The design known from EP 1 312 527 B1 is disadvantageous because the basic body has a substantial longitudinal extent, the main portion of which is arranged below the car. This makes it necessary for the car builder to provide room in this area of the car, which takes up the basic body and the elements of the articulated arm arranged inside the basic body.

From EP 1 925 523 B1 a bearing bracket is known that has a vertically extending swivel pin arranged to pass through an eye arranged in a coupling rod and thereby forming a spherical bearing. The eye in the coupling rod is larger than the diameter of the swivel pin. The space created is filled with an elastic material that allows the coupling rod to move in a longitudinal direction relative to the swivel pin. The use of the elastic material pretensions the coupling rod into a predetermined, normal position relative to the swivel pin. The bracket is provided with vertical contact faces, one above the horizontal plane that contains the center line of the coupling rod, one below the horizontal plane that contains the center line of the coupling rod. The coupling rod also is provided with vertical contact surfaces, one surface above the horizontal plane that contains the center line of the coupling rod and one surface arranged below the horizontal plane that contains the center line of the coupling rod. In the normal state and defined by the elastic properties of the material arranged in the eye in the coupling rod, the contact surfaces of the bracket and the coupling rod are arranged to face each other but are distanced apart. If the coupling rod is moved by a predetermined force that overcomes the resilience of the elastic material arranged in the eye, the coupling rod is pushed towards the bracket in such a manner that the contact surfaces of the bracket come into contact with the contact surfaces of the coupling rod. This arrangement limits the distance that the coupling rod can move relative to the bracket. Also the use of contact surfaces above and below the horizontal plane that contains the center line of the coupling rod provides a stabilizing function that returns the coupling rod into a horizontal alignment in cases, where the coupling rod at the time of being pushed towards the bracket is not arranged in a horizontal alignment. In such a case, the contact surface of the coupling rod arranged on the one side of the horizontal plane that contains the center line will contact its counterpart contact surface of the bracket earlier. Continuous application of a force along the longitudinal axis of the coupling rod will then lead to a return-moment that will return the coupling rod into the horizontal alignment. EP 1 925 523 B1 describes as further embodiment the placement of a deformation tube as part of the coupling rod. The deformation tube is of such a design that it will only start to take up energy, once the contact surfaces have made contact. The design known from EP 1 925 523 B1 is disadvantageous, because the resilience of the elastic material works to move the surfaces out of contact and thus works against the stabilizing effect.

Based on this background the problem to be solved by the invention is to suggest a bearing bracket, an assembly containing such a bearing bracket and a system containing such an assembly as well as multi-car vehicle that does away with at least one of the disadvantages of the above cited prior art.

This problem is solved by embodiments of the assembly, the bearing bracket, the system and the multi-car vehicle described in the description following hereafter.

The basic idea of the bearing bracket according to the invention is to make use of the stabilizing effect that the interaction of a surface arranged on the coupler rod or connection rod with a surface of the bearing bracket can have, if they are brought into contact with each other upon the application of a pushing force of a predetermined strength. According to the invention, this stabilizing effect can be used in a driving condition, where a group of parts of the bearing bracket is purposefully set free to move relative to the bracket, if a pushing force of a predetermined strength is applied to the coupler rod or connection rod. Such driving conditions occur, for example, if the movement of the group of parts is used to deform an energy absorbing element placed behind the bearing bracket.

SUMMARY

The assembly according to the invention can be used with several types of connections that connect a first car of a multi-car vehicle to a second car of a multi-car vehicle. The coupler rod or connection rod used as part of the assembly according to the invention is thus adapted to the specific use of the assembly. As described above in the introduction, multi-car vehicles are formed by connecting individual cars of the vehicle to one another by means of a connection device. Such a connection device can have a coupler head as part of the connection device, which allows easy decoupling. If the assembly according to the invention is to be used in conjunction with such a connection, the assembly will have a coupler rod attached to the adapter. For a "semi-permanent" coupling of the cars, the assembly of the invention can have a connection rod attached to the adapter. In a different embodiment, where the cars of the multi-car vehicles do not need to be detached easily, the connection device that connects the cars can simply be one connection rod that is attached at one end to one car using the bearing bracket according to the invention and is attached at the other end to a second car, preferably also using the bearing bracket according to the invention at this end.

To facilitate the discussion, reference will be made below to "the rod" which is to be understood as reference to the coupler rod and the connection rod, depending on which of the two is used in the specific design of the assembly or the bearing bracket according to the invention.

The bearing bracket of the assembly according to the invention has an adapter that is adapted such that the rod can be connected to it, which includes the possibility that the adapter is formed as one piece with a unitary rod or as one piece with parts of a multi-piece rod.

The bearing bracket of the assembly according to the invention also has a bracket forming part of a car or being a bracket suitable for being connected to a car of a multi-car vehicle. Often, bearing brackets are designed as pieces that are fitted to cars, whereby the car, for example the car's underframe is adapted to receive the bearing bracket, but whereby the bearing bracket is designed to provide its functions only with pieces of the bearing bracket. For example designs are known, where the energy adsorption is provided by elements that form part of the bearing bracket. On the other hand, designs are feasible, where some of the functions of the bearing bracket, for example the energy adsorption, is provided by parts of the car, for example by deformation tube arranged within the underframe of the car. For this reason, the invention is directed to both types of designs, namely on the one hand designs where a bracket of the bearing bracket is designed to be suitable for being connected to a car of a multi-car vehicle and thus all primary functions being inherently provided by elements of the bearing bracket itself. On the other hand, the invention is also directed to designs, where the bracket forms a part of a car, for example a part of the underframe of the car and thus some of the functions of the bearing bracket, for example the energy adsorption, is at least partially provided by elements of the car.

The bearing bracket of the assembly according to the invention also has a joint arranged in such manner that it allows the adapter to swivel relative to the bracket about at least one swivel axis. This can be the vertical axis or the horizontal axis. Designs are also feasible, where the joint is arranged in such manner that it allows the adapter to swivel relative to the bracket about more than one swivel axis, for example about the horizontal and the vertical axis.

The rod of the assembly according to the invention has at least one surface that extends in a plane that is at an angle relative to the longitudinal axis of the rod, which is meant to be a plane that does not contain the longitudinal axis and is not parallel to the longitudinal axis. This surface is held spaced apart from a surface of the bearing bracket. This can be achieved by an elastic element arranged between a first element and a second element of the elements in the line of flow of force for transmitting forces acting along the longitudinal axis of the rod to the bracket that by its resilience keeps the first element spaced apart from the second element and whereby the surface of the rod comes into contact with the surface of the bearing bracket, if a pushing force of a predetermined strength is applied to the rod that overcomes at least a part of the resilience of the elastic element. Such a design is for example shown in EP 1 925 523 B1. In addition or as an alternative, the surface is held spaced apart from a surface of the bearing bracket until a pushing force of a predetermined strength is applied to a connection between a first element and a second element of the elements in the line of flow of force for transmitting forces acting along the longitudinal axis of the coupler rod or the connection rod to the bracket that brakes the connection and sets the first element free to move relative to at second element, which movement allows the surface of the rod to come into contact with the surface of the bearing bracket.

For example, the part of the rod that has the surface can be directly or indirectly connected to the first element and the bracket can be connected directly or indirectly to the second element. The connection between the rod and the first element can be rigid or at least only has so little play (for example by interposed elastic elements) that the space between the surfaces is not used up. The connection between the bracket and the second element can be rigid or at least only has so little play (for example by interposed elastic elements) that the space between the surfaces is not used up. If the first element and the second element now have a connection that can brake, if a pushing force of a predetermined strength is applied to it, for example if the connection is made up of a shear off bolt, the surfaces can be brought into contact by application of such a pushing force to the connection. This connection can, for example, be provided by shear-off bolts. Also, it is feasible that the first element and the second element are welded together or are glued together and are torn apart upon application of the predetermined force. Also it is feasible that the first element and the second element are provided by one element that has a predetermined breaking point or a predetermined breaking line provided by a weakness in the material or provided by the material at this point/line being very thin.

According to the invention, a group of parts of the bearing bracket, which includes the adapter and the joint, are connected to the bracket by at least one element, for example a shear off element, in such a manner that the group of parts is set free to move relative to the bracket, if a pushing force of a predetermined strength is applied to the coupler rod or connection rod, for example if the shear off bolt shears off. This connection can, for example, be provided by shear-off bolts. Also, it is feasible that the element and the bracket are welded together or are glued together and are torn apart upon application of the predetermined force. Also it is feasible that the element and the bracket are provided by one element that has a predetermined breaking point or a predetermined breaking line provided by a weakness in the material or provided by the material at this point/line being very thin.

Setting the group of parts free to move relative to the bracket does not necessarily need to mean that the group of parts is fully free to move in one direction. It only means that the group of parts is no longer held back by a connection to the bracket. For example, the group of parts when set free to move relative to the bracket can start to deform an energy absorbing element.

In a preferred embodiment, an energy absorbing element that is deformed by the movement of a part of the group of parts set free to move relative to the bracket is provided as part of the assembly. This energy absorbing element can, for example, be arranged behind the bracket, for example connected to parts of the underframe of the car to which the bracket is connected or of which the bracket forms a part of. The energy absorbing element can for example an energy adsorbing element, for example a deformation tube or a honeycomb element.

In a preferred embodiment, the rod has an energy absorbing element, preferably an energy adsorbing element, for example a deformation tube or a honeycomb structure formed as part of it. This allows for a staggered approach to energy absorption. At a first force level the surfaces can be brought into contact. At a second force level, the energy adsorbing element in the rod can be initiated and if this energy adsorbing element in the rod is used up, the group of parts is set free to move relative to the bracket and deforms the further energy absorbing element. As an order of magnitude, the predetermined force necessary to bring the surfaces into contact can in a preferred embodiment be in the magnitude of 500 to 800 kN, whereby the force to initiate the energy adsorption of the energy absorbing element can in a preferred embodiment be in the magnitude of 1000 to 1800 kN. In a preferred embodiment, the force necessary force to initiate the energy adsorption in the rod and the force necessary to initiate the further energy adsorbing element is of the same order of magnitude, preferably substantially the same. In such an embodiment, initiation of the further energy adsorbing element later than the energy adsorbing element in the rod can be provided by shear off elements holding the group of parts apart from the further energy adsorbing element or the further energy adsorbing element being connected to a part of the group of parts on one of its side being held by shear off elements distanced from a counter surface arranged opposite its other side.

The interaction of the surface of the rod and the surface of the bearing bracket can provide a stabilizing function. If the rod is misaligned from a predetermined horizontal orientation in a crash scenario, the contact of the surfaces can lead to a rectifying momentum that brings the rod back into a predetermined horizontal alignment.

In a preferred embodiment, the surface that extends at an angle relative to the longitudinal axis of the rod extends into the vertical direction (is in a vertical plane) or in an angle to the vertical that is not the horizontal (is in an angled plane to both the vertical and the horizontal). Preferably the surface of the bearing bracket extends into the vertical direction (is in a vertical plane) or in an angle to the vertical that is not the horizontal (is in an angled plane to both the vertical and the horizontal). Preferably, the surface on the rod is parallel to the surface of the bearing bracket, if the rod is aligned in a predetermined horizontal position (for example in line with the longitudinal axis of the car or the multi-car vehicle). The interaction between surfaces that extend in the vertical direction above or below the rod will allow to create a momentum that returns a rod into a predetermined horizontal position, even if during the collision the rod does not extend along a horizontal plane, but at an angle to a horizontal plane. Surfaces that interact with each other and extend in a horizontal direction sidewise from the rod allow a rod to be returned in a predetermined horizontal position, if during a collision, the rod is within the predetermined horizontal plane, but extends at an angle to the desired, predetermined direction along which the longitudinal axis of the rod should extend. It is preferred, for example, that in an arrangement, where the assembly according to the invention is arranged as part of a train that the rod extends in a horizontal plane and extends in the horizontal direction that points along the longitudinal axis of the complete train. The use of vertically extending and horizontally extending surfaces as described above allow for the rod to be returned into this preferred position, if the rod is not in this position during a collision. The assembly according to the invention is thus in a position to achieve the same advantages as the design known from EP 1 925 523 B1.

In a preferred embodiment, the rod has a cylindrical or elliptical outer shape in the region where the surface extends at an angle relative to the longitudinal axis of the rod and the surface that extends at an angle relative to the longitudinal axis of the rod is provided by an element attached to the rod, which element has a cross section that is substantially shaped like a triangle. This design, wherein the surface is provided by an element attached to the rod that "like an ear" extends from the cylindrical or elliptical basic body of the rod provides a design that can be put into practice easily without changing the basic design of a coupler rod or a connection rod. In a preferred embodiment, four such elements that provide the surface are provided, one element in each quadrant. The triangle-shaped cross section of the elements that provide the surfaces can be arranged such that with the side surfaces of the elements joining each other an element with the circumference of a rectangle is formed. The surfaces can also be provided by a collar that is provided on the outer circumference of the rod.

In a preferred embodiment, the surface that extends at an angle relative to an longitudinal axis of the rod is arranged above and/or below the horizontal plane that contains the longitudinal axis of the coupler rod or connection rod and/or left or right of the vertical plane that contains the longitudinal axis of the coupler rod or connection rod. The surface should be placed at a position relative to the longitudinal axis of the rod, where it will be necessary to act against the misalignment of the rod that is to be expected to take place most likely. If it is, for example, expected that the rod in a collision situation has a position, wherein the end of the rod distanced from the assembly is higher than the end of the rod that is connected to the adapter of the assembly, the surfaces should be arranged above the longitudinal axis of the coupler rod. The arrangement of the surfaces above the horizontal plane that contains the longitudinal axis will lead to a momentum that moves a misaligned rod that is in such a position back into the horizontal plane. In a preferred embodiment, the surfaces are provided above and below the horizontal plane that contains the longitudinal axis of the rod and right and left to the vertical plane that contains the longitudinal axis of the rod. The "longitudinal axis of the rod" in the discussion of this preferred embodiment refers to the position that the longitudinal axis of the rod takes in the predetermined, preferred position of the rod, for example the normal driving state of the rod.

In a preferred embodiment the rod contains four surfaces that are arranged in the same plane, whereby in each of the quadrants delimited by the horizontal plane that contains the longitudinal axis of the rod and the vertical plane that contains the longitudinal axis of the rod, one of the four surfaces is arranged.

In a preferred embodiment a part of the group of parts set free to move relative to the bracket has a cut-out that engages with a guide-bar that guides the movement of that part. This guide-bar can, for example be attached to parts of the underframe of the car. The cut-out can also be provided by a claw-like element. Likewise, in a preferred embodiment a part of the group of parts set free to move relative to the bracket has a protruding guide-bar that engages with a cut-out that guides the movement of that part, for example a cut-out or recess arranged in the underframe of a car. Preferably the cut-out and the guide bar are arranged in such a manner that they can take up a momentum around a horizontal axis perpendicular to the longitudinal axis of the coupler rod or the connection rod. This can lead to an additional stabilizing force during the movement of the group of parts. In a preferred embodiment, two cut-outs are provided on parts of the group of parts set free to move and two guide-bars are provided to interact with the cut-outs, the guide bars preferably being arranged opposite each other such as to provide a good guidance. Likewise, in a preferred embodiment, two guide-bars are provided on parts of the group of parts set free to move and two cut-outs are provided to interact with the guide-bars, the guide bars preferably being arranged opposite each other such as to provide a good guidance.

The basic idea of the bearing bracket according to the invention is to provide a two-step shear-off system as part of the bearing bracket. The bearing bracket according to the invention has an adapter that is adapted such that the coupler rod or the connection rod can be connected to it, which also includes the possibility that the adapter is made as one piece with the rod or parts of the rod. The bearing bracket also has a bracket forming part of a car or being a bracket suitable for being connected to a car of a multi-car vehicle and has a joint that is arranged in such a manner that it allows the adapter to swivel relative to the bearing bracket about at least one swivel axis. The joint connects the adapter to a joint receiving part in such a manner that the adapter is set free to move relative to at least some parts of the joint receiving part in at least one direction, if a pushing force of a predetermined strength is applied to the adapter that points into this at least one direction. This possibility to set the adapter free to move relative to at least some parts of the joint receiving part provides the first step of the shear-off concept. Additionally, the bearing bracket according to the invention provides for the joint receiving part to be connected to the bracket in such a manner that the joint receiving part is set free to move relative to the bracket, if a pushing force of a predetermined strength is applied to the receiving part. This arrangement of the joint receiving part in the bracket provides for the second step of the shear-off concept.

Where reference is made in this description to a force that points into a direction, it is to be understood that this includes reference to a component of a force. For example if the rod is held at an angle to the horizontal plane and a pushing force is applied to the rod, this pushing force will have a horizontal component, that is considered within this description to be a force that points into the horizontal direction. Thus, if in a preferred embodiment the joint connects the adapter to a joint receiving part in such a manner that the adapter is set free to move relative to at least some parts of the joint receiving part in the horizontal direction, if a pushing force of a predetermined strength is applied to the adapter that points into the horizontal direction, this will also be achieved, if the rod is held at an angle to the horizontal plane and a pushing force is applied to the rod, whereby for the function of this specific embodiment, the horizontal component of this force is considered the pushing force of a predetermined strength that is applied to the adapter that points into the horizontal direction.

Dividing the shear-off concept into two parts as one advantage allows the bearing bracket according to the invention to react differently to different levels of force acting onto it. The design of the bearing bracket according to the invention allows for the bearing bracket to respond in a first way, if a first, lower level of force is reached, for example a force level just above the force levels allowed for coupling two trains with automatic couplers. Providing the second shear-off step allows the bearing bracket to react to the application of higher forces, for example the forces of a substantial collision. In such a case, an energy-dissipating element provided in a preferred embodiment as part of the bearing bracket or behind the bearing bracket could be activated.

The two-step shear-off concept of the bearing bracket according to the invention also provides for the opportunity to use the relative movement of the adapter relative to at least some parts of the joint receiving part to arrange movable elements of the bearing bracket into a better position for the second shear-off step or for steps that will follow the second shear-off step, for example the deformation of energy-dissipating elements (if they are provided in a preferred embodiment of the invention). For example, the invention in a preferred embodiment provides for the possibility to align the coupling rod or connection rod into an horizontal alignment after the first shear-off step, but before the second shear-off step. This alignment of the coupler rod or the connection rod that takes place in this preferred embodiment after the first shear-off step can be used to either improve the second shear-off step to take place in a controllable manner or can be used for letting the re-aligned coupler rod or connection rod deform a deformation element after the second shear-off step and control this deformation of the deformation element.

In a preferred embodiment, the joint has a least one joint pin that is partially held in a receptacle of the joint receiving part. FIGS. 3 to 7 of EP 1 925 523 B1 show such a joint that has a vertical joint pin that is received into the receptacles. One receptacle is provided as a hole in an upper part of the bearing bracket. One further receptacle is provided as a hole in the lower part of the bearing bracket of EP 1 925 523 B1. The joint for the bearing bracket according to the invention can in a preferred embodiment also be of the type shown in FIGS. 1 and 2 of EP 1 925 523 B1, whereby the joint has a top joint pin and a (separate) bottom joint pin. The top joint pin being received by a hole in the top part of the bearing bracket, the (separate) bottom joint pin being held by a hole in a bottom part of the bearing bracket of EP 1 925 523 B1. In a preferred embodiment the at least one joint pin is arranged to extend in the vertical direction.

In a preferred embodiment, the receptacle that holds the joint pin is provided by at least two parts of the joint receiving part, each of the at least two parts forming a part of the wall that delimits the receptacle, whereby the two parts are connected to each other by a connection that upon application of a force of a predetermined strength can shear off. This connection can, for example, be provided by shear-off bolts. Also, it is feasible that the two parts are welded together or are glued together and are torn apart upon application of the predetermined force. Also it is feasible for the two parts of the joint receiving part to be provided by one element that has a predetermined breaking point or a predetermined breaking line provided by a weakness in the material or provided by the material at this point/line being very thin. In a preferred embodiment, the force of a predetermined strength can be of the order of magnitude of 1000 kN, preferably a little above 1000 kN, for example around 1050 kN or 1100 kN.

In a preferred embodiment, the two parts are connected to each other by means of shear-off bolts that are arranged around the longitudinal axis of the coupling rod or connection rod. Preferably, the two parts are connected by two shear-off bolts that are arranged in the same horizontal plane. In a preferred embodiment, the joint pin is received in a receptacle of an upper joint receiving part and by a receptacle of a lower joint receiving part. In this embodiment, both joint receiving parts are provided by at least two parts as described above, each of the two receptacles having two shear-off bolts, the two shear-off bolts per joint receiving part connecting the respective two parts of the joint receiving part together. This total of four shear-off bolts provided in this preferred embodiment is preferably arranged at the same distance to the vertical plane that contains the longitudinal axis. Additionally or as an alternative, all four bolts are being arranged at the same distance to the horizontal plane that contains the longitudinal axis. Such a design allows for a symmetric arrangement of the shear-off bolts, which favors the shearing out of the shear-off bolts to take place at the same time, especially in a situation where the coupler rod or the connection rod is in horizontal alignment.

In a preferred embodiment, one of the two parts of the joint receiving part for at least a part of its extent has the shape of a horseshoe. Using the shape of a horseshoe allows for this part of the joint receiving part to partially encompass the joint pin.

In a preferred embodiment, the joint receiving part has at least one flange that is connected to the bracket by means of a connection that upon application of a force or predetermined strength can shear off. This connection can, for example, be provided by shear-off bolts. Also, it is feasible that the two parts are welded together or are glued together and are torn apart upon application of the predetermined force. Also it is feasible for the two parts to be provided by one element that has a predetermined breaking point or a predetermined breaking line provided by a weakness in the material or provided by the material at this point/line being very thin. In a preferred embodiment, the force of a predetermined strength can be of the order of magnitude of 1000 kN, preferably a little above 1000 kN, for example around 1050 kN or 1100 kN.

Such a connection between the joint receiving part and the bracket allows for a simple way to arrange the second step of the shear-off concept of the bearing bracket according to the invention. In a preferred embodiment, the two parts are connected to each other by means of shear-off bolts that are arranged around the longitudinal axis of the coupling rod or connection rod. Preferably, the two parts are connected by two shear-off bolts that are arranged in the same horizontal plane. In a preferred embodiment, the two flanges and the bracket are connected by four shear-off bolts. This total of four shear-off bolts provided in this preferred embodiment is preferably arranged at the same distance to the vertical plane that contains the longitudinal axis. Additionally or as an alternative, all four bolts are being arranged at the same distance to the horizontal plane that contains the longitudinal axis. Such a design allows for a symmetric arrangement of the shear-off bolts, which favors the shearing out of the shear-off bolts to take place at the same time, especially in a situation where the coupler rod or the connection rod is in horizontal alignment.

In a preferred embodiment, a damping element is arranged such as to dampen the transmission of impacts from the adapter to the bracket. The adapter can, for example, have an eye that receives the joint pin similar to the arrangement of EP 1 925 523 B1, FIGS. 3 to 7, where a joint pin is received in an eye of the coupling rod. In such an arrangement, elastic material can be provided inside the eye that dampens impact forces that are transmitted from the adapter to the joint pin (and thus to the bracket). Providing such damping elements can reduce small impacts from being introduced into the bracket and thus into the car to which the bracket is connected. Such an arrangement can thus reduce the rattle that is introduced into a car.

In an alternative embodiment, no damping element is arranged such a to dampen the transmission of impacts from the adapter to the bracket. In an even preferred embodiment, no elastic material, especially no rubber material is provided to dampen the transmission of impacts from the adapter to the bracket. Dampening the impacts that are introduced from the adapter to the bracket could lead to malfunction or the shear-off elements. To ensure that the shear-off elements shear off at a predetermined force level, it might be preferred, to not provide any damping material as part of the bearing bracket.

In a preferred embodiment, the joint has a vertically extending joint pin that is connected to the joint receiving part and has a horizontally extending joint pin that is connected to the vertically extending joint pin and to the adapter. Alternatively, in a preferred embodiment, the joint has a horizontally extending joint pin that is connected to the joint receiving part and has a vertically extending joint pin that is connected to the horizontally extending joint pin and the adapter. Such designs in the end lead to a universal joint (a cardan joint) and thus allows for the adapter to swivel relative to the joint receiving part about a vertical axis, but also about a horizontal axis.

In a preferred embodiment, the receptacle is provided by at least two parts of a joint receiving part that after a shear-off having taken place can move relative to each other and whereby the one of the two parts guides the movement of the other of the two parts such that the other of the two parts moves in a linear movement relative to the guiding part of the two parts. Such an arrangement ensures that the movement of elements within the bearing bracket according to the invention is controlled to take place in a specific direction after the first shear-off has taken place.

In a preferred embodiment the joint bearing part has at least two vertically extending flanges, whereby the two vertically extending flanges each have a horizontally extending cut-out that engages with the respective one of two guide-bar that are arranged facing inward into a hole formed in the bracket, through which hole the joint bearing part can move once it is set free to move relative to the bracket, if a pushing force of a predetermined strength is applied to the joint receiving part. Preferably the recesses on the two vertically extending flanges and the two guide bars are arranged in such a manner that they can take up a momentum around a horizontal axis perpendicular to the longitudinal axis of the coupler rod or the connection rod. Alternatively, in a preferred embodiment the joint bearing part has at least two vertically extending flanges, whereby the two vertically extending flanges each have a horizontally extending guide-bars that engages with the respective one of two cut-outs that are arranged recessing from a hole formed in the bracket, through which hole the joint bearing part can move once it is set free to move relative to the bracket, if a pushing force of a predetermined strength is applied to the joint receiving part. Preferably the guide-bars on the two vertically extending flanges and the two recesses are arranged in such a manner that they can take up a momentum around a horizontal axis perpendicular to the longitudinal axis of the coupler rod or the connection rod.

As an alternative or as a preferred embodiment of the assembly described above, the assembly according to the invention comprises the bearing bracket according to the invention and a coupler rod or a connection rod that is attached to the adapter of the bearing bracket according to the invention.

The rod in a preferred embodiment has a cross section perpendicular to the longitudinal axis of the rod that has the shape of a circle, the shape of a ring (if the rod is of at least partially hollow design), the shape of an ellipse or the shape of an elliptical ring (if the rod is to be designed at least partially hollow). The shape of the cross section of the rod can change along its longitudinal extent. Energy-consuming elements can be integrated into the rod. For example, the rod can have an hydraulic cylinder that dampens forces acting along its longitudinal axis integrated into the rod at a position along the longitudinal extent of the rod. Also, energy-dissipating element, like honeycomb elements or deformation tubes can be integrated into the rod to dissipate energy, if forces above a predetermined threshold value act along the longitudinal axis of the rod. Also rubber elements, for example rubber elements of donut-shape can be integrated into the rod to take up energy.

In a preferred embodiment, the adapter of the bearing bracket according to the invention is formed as one piece with parts of the rod. In a preferred embodiment, the adapter is formed by two parallel extending, spaced-apart, plate-like sections that extend from the rod in a direction along the longitudinal axis of the rod. Preferably, the two parallel plate-like sections each contain a hole to receive the opposite ends of a joint pin. The joint pin can be a horizontally extending joint pin, can be a vertically extending joint pin or can be a joint pin that extends at an angle to the horizontal and the vertical direction. In a different embodiment, the adapter can be the end section of the rod. In this embodiment, the rod can have an end section that has the same diameter as the remaining majority of sections of the rod. In a preferred embodiment, however, a rod with an end section that is used as an adapter has an end section with a reduced thickness in one direction. For example EP 1 925 523 B1 shows a coupler rod (Kupplungsstange 20) with an end section (Endabschnitt 21) that has a reduced thickness in the vertical direction.

In an alternative embodiment, the adapter is formed as a separate piece to the rod. The adapter can, for example, have an end plate, for example a vertically extending plate. The rod to be connected to the adapter can also have an end plate that can be connected to the end plate of the rod, for example by means of screws.

As an alternative or as a preferred embodiment to the assembly of the invention described above, an assembly according to the invention has a bearing bracket suitable to connect a coupler rod or a connection rod to a car that comprises

- an adapter that is adapted such that the coupler rod or the connection rod can be connected to it,
- a bracket suitable for being connected to the car,
- a joint arranged in such manner it allows the adapter to swivel relative to the bracket about at least one swivel axis, whereby the joint connects the adapter to a joint receiving part in such a manner that the adapter is set free to move relative to at least some parts of the joint receiving part in at least one direction, if a pushing force of a predetermined strength is applied to the adapter that points into this at least one direction, whereby the joint bearing part has at least two vertically extending flanges and whereby the two vertically extending flanges each have a horizontally extending cut-out that engages with the respective one of two guide-bar that are arranged facing inward into a hole formed in the bracket, through which hole the joint bearing part can move once it is set free to move relative to the bracket, if a pushing force of a predetermined strength is applied to the joint receiving part, whereby the movement of the joint bearing part deforms a energy absorbing deformation element, preferably an energy adsorbing deformation element.

This design of the assembly according to the invention already provides advantages, if it is implemented with just one stage of a shear-off. In this alternative, it is used as an advantage that due to the shear-off that sets the adapter free to move relative to at least some parts of the joint receiving part, a movement is provided that can be used to deform an energy-absorbing deformation element. Due to the design of the two guide-bars that guide the joint bearing part through the hole in the bracket, a controlled movement of the joint bearing part is achieved and thereby a controlled deformation of the energy-absorbing deformation element is achieved. For example, deformation elements are known that work best, if they are deformed along a longitudinal axis. For example, a deformation tube works best, if the force that is introduced into the energy-absorbing deformation element in order to deform that element acts along the longitudinal axis of the deformation tube. The design of the assembly according to the invention described in this paragraph allows to introduce the forces into the energy-absorbing deformation element along such a preferred longitudinal axis due to the guidance of the two guide-bars.

In a preferred embodiment, the part of the joint receiving part that deforms the energy-absorbing deformation element is arranged distanced from the energy-absorbing deformation element before the joint bearing part is set free to move. Such a design prevents the energy-absorbing deformation element to be weakened by rattle or cyclic forces that might occur during normal driving conditions of a multi-car vehicle that contains the assembly according to the invention.

In a preferred embodiment, upon deformation of the energy absorbing deformation element only a force pointing in the longitudinal direction of the guide-bars is applied to the energy absorbing deformation element.

In the system according to the invention an assembly according to the invention is provided and a car, whereby the bracket of the bearing bracket of the assembling of the invention is attached to the car.

In a preferred embodiment, the car underframe has a clearance (a hole, a recess), whereby the rod moves through the clearance once the joint receiving part is set free to move relative to the bracket, if a pushing force of a predetermined strength is applied to the joint receiving part. In an even preferred embodiment, an energy-absorbing element is arranged such as to come into contact with an element of the bearing bracket and takes up energy once the joint receiving part is set free relative to the bracket, if a pushing force of a predetermined strength is applied to the joint receiving part.

In a preferred embodiment, the energy-absorbing element is attached to a frame that takes up forces that have been introduced into the energy-absorbing element by an element of the bearing bracket and redirects these forces back towards an area of the car, where the clearance is arranged. In the specific embodiment described it is ensured that those forces that are not taken up by the energy-absorbing deformation element, because they exceed the energy take-up of the deformation element can be introduced into the underframe of the car at a specific point. Underframes of cars are often designed to have longitudinal beams into which longitudinal forces should be introduced in order to safely pass them along the car without leading to unwanted deformations of elements of the car. The design described above, whereby the forces exceeding the take-up of the energy-absorbing deformation element are redirected back towards an area of the car, where the clearance is arranged allows for these longitudinal beams of the underframe that are known from the prior art to still be used in order to transmit the forces exceeding the take-up of the energy-absorbing deformation element along the underframe of the car in the manner known from the prior art.

The arrangement suggested by this preferred embodiment of the system according to the invention provides the advantage to separate the bearing bracket and energy-absorbing elements. The energy-absorbing elements can be arranged as part of the underframe of the car or can be attached to the underframe of the car. They are arranged in such a position that an element of the bearing bracket according to the invention that is set free to move can come into contact with the energy-absorbing deformation element and can deform this deformation element. Separating the bearing bracket and the energy-absorbing deformation element provides the advantage, for example to separately renew the pieces or to separately check the conditions of either of the elements.

In the above described embodiments the energy-absorbing deformation element preferably is an energy-adsorbing element, for example a deformation tube or a honeycomb-structure.

Multi-car vehicle according to the invention has a first car of the multi-car vehicle and a second car of said vehicle and has a connection device having

- a coupler rod or an connection rod in form of an elongated body suitable for transmitting the pushing force required to push the first car in front of the second car, when the second car is moving,
- the elongated body having a longitudinal axis,
- a connection suitable to connect the elongated body to the first car or the second car and suitable to transmit the pushing force from the second car to the elongated body or from the elongated body to the first car, the first car and or the second car having an underframe that comprises at least one longitudinal beam and/or at least one cross beam, whereby the elongated body is arranged approximately at the same vertical level as the longitudinal beam and/or the cross beam and/or is arranged in such a manner that with regard to the vertical direction the elongated body at least partially overlaps with the beam whereby the multi-car vehicle comprises a bearing bracket according to the and/or an assembly according to the invention and/or a system according to the invention.

In a preferred embodiment the underframe has a central longitudinal beam that is arranged approximately along the longitudinal axis of the first car, whereby the elongated body is arranged approximately at the same vertical level as the central longitudinal beam and/or is arranged in such a manner that with regard to the vertical direction the elongated body at least partially overlaps with the central longitudinal beam.

In a preferred embodiment the underframe has a cross beam supported by a bogie, whereby the elongated body is arranged approximately at the same vertical level as the cross beam supported by the bogie and/or is arranged in such a manner that with regard to the vertical direction the elongated body at least partially overlaps with the cross beam supported by the bogie.

In a preferred embodiment the underframe has side-beams that run parallel to the longitudinal axis of the first car, but at the sides of the first car and whereby the side-beams end before the end of the first car and whereby a door of the first car is arranged in the section of the first car that has no side-beam.

In a preferred embodiment the connection device comprises a connection,

- the connection defining a pivot axis about which the elongated body can pivot relative to other parts of the connection, the pivot axis crossing the elongated body and/or the longitudinal axis,
- the connection having connecting parts suitable to be connected to the first car, whereby the elongated body is elastically connected to the connection parts thereby allowing the elongated body to move relative to the connecting parts in the direction of the longitudinal axis whereby a first blocking surface or a first locking member being arranged on the elongated body on one side of the pivot axis, the first blocking surface or first locking means being held distanced from a corresponding blocking surface or a corresponding locking means respectively arranged on the connecting parts in a first operational state and the first blocking surface or the first locking means being in contacted with the corresponding blocking surface or the locking means in a second operational state, when the elongated body has been moved along its longitudinal axis relative to the connecting parts, the contact between the respective blocking surfaces or the contact between the respective locking means blocking a rotation of the elongated body about the pivot axis and a second blocking surface or a second locking member being arranged on the elongated body on the opposite side of the pivot axis relative to the first blocking surface or the first locking means, the second blocking surface or second locking means being held distanced from a corresponding blocking surface or a corresponding locking means respectively arranged on the connecting parts in a first operational state and the second blocking surface or the second locking means being in contacted with the corresponding blocking surface or the locking means in a second operational state, when the elongated body has been moved along its longitudinal axis relative to the connecting parts, the contact between the respective blocking surfaces or the contact between the respective locking means blocking a rotation of the elongated body about the pivot axis.

In a preferred embodiment the elongated body is a bar, whereby the bar has an inclined surface provided at a front end section of the bar and in that a counter-surface is arranged to come into contact with the inclined surface to prevent the bar to move further in the vertical direction than the interaction between the inclined surface and the counter-surface allows or that the bar has a counter-surface provided at a front end section of the bar and in that an inclined surface is arranged to come into contact with the counter-surface to prevent the bar to move further in the vertical direction than the interaction between the inclined surface and the counter-surface allows.

In a preferred embodiment the connection comprises a plate that has a hole, through which the bar passes, the hole being big enough so that the bar can pass through the hole without touching the sidewalls delimiting the hole and the connection comprises a vertical limitation part that limits the vertical movement of a section of a horizontally extending bar, whereby the vertical limitation part limits the vertical movement of the section of the bar that passes through the hole, when the bar is extending horizontally, and/or the vertical movement of a section of the bar in the proximity of the hole, whereby the vertical limitation part is designed to limit the vertical movement only at a place proximate the plate, while it allows vertical movements further away from the plate to allow the bar to swivel about a horizontal axis at or in proximity of the plate with the hole in and/or a lateral limitation part that limits the sideways movement of a section the bar when the bar is extending horizontally, whereby the lateral limitation part limits the sideways movement of the section of the bar that passes through the hole, when the bar is extending horizontally, and/or the sideways movement of a section of the bar in the proximity of the hole, whereby the lateral limitation part is designed to limit the lateral movement only at a place proximate the plate, while it allows lateral movements further away from the plate to allow the bar to swivel about a vertical axis at or in proximity of the plate with the hole in and/or a rotational limitation part that limits rotational movements of a section of the bar and/or an axial limitation part that limits the axial movement of the bar relative to the plate that has a hole in at least in the forward or the rearward axial direction of the bar.

In a preferred embodiment an axial limitation part and a vertical limitation part are provided and that the horizontal axis about which the bar is allowed to swivel changes its position relative to the plate that has a hole in depending on the axial position of the bar and/or an axial limitation part and a lateral limitation part are provided and that the vertical axis about which the bar is allowed to swivel changes its position relative to the plate that has a hole in depending on the axial position of the bar.

In a preferred embodiment, a gangway floor for a gangway between a first car of the multi-car vehicle and a second car of said vehicle is provided whereby the gangway floor comprises a first floor panel and a second floor panel, whereby the first floor panel is arranged to rotate about a first axis that does not lie in the plane that the first floor panel lies in and the second floor panel is arranged to rotate about a second axis that does not lie in the plane that the second floor panel lies in, whereby the first axis is different to the second axis and the first axis coincides with the pivot axis.

In a preferred embodiment a gangway floor for a gangway between a first car of the multi-car vehicle and a second car of said vehicle is provided whereby the gangway floor comprises a first floor panel that has the shape of a sector of a circle or the shape of a segment of a circle or the shape of a sector of a ring and a second floor panel that has the shape of a sector of a circle or the shape of a segment of a circle or the sector of a ring.

BRIEF DESCRIPTION OF THE DRAWINGS

Below, the invention will be described with reference to Figures that only show exemplatory embodiments of the invention. In the Figures, the following is shown In the drawings.

DETAILED DESCRIPTION OF PREFERRED EMBODIMENTS

Figure 7A:
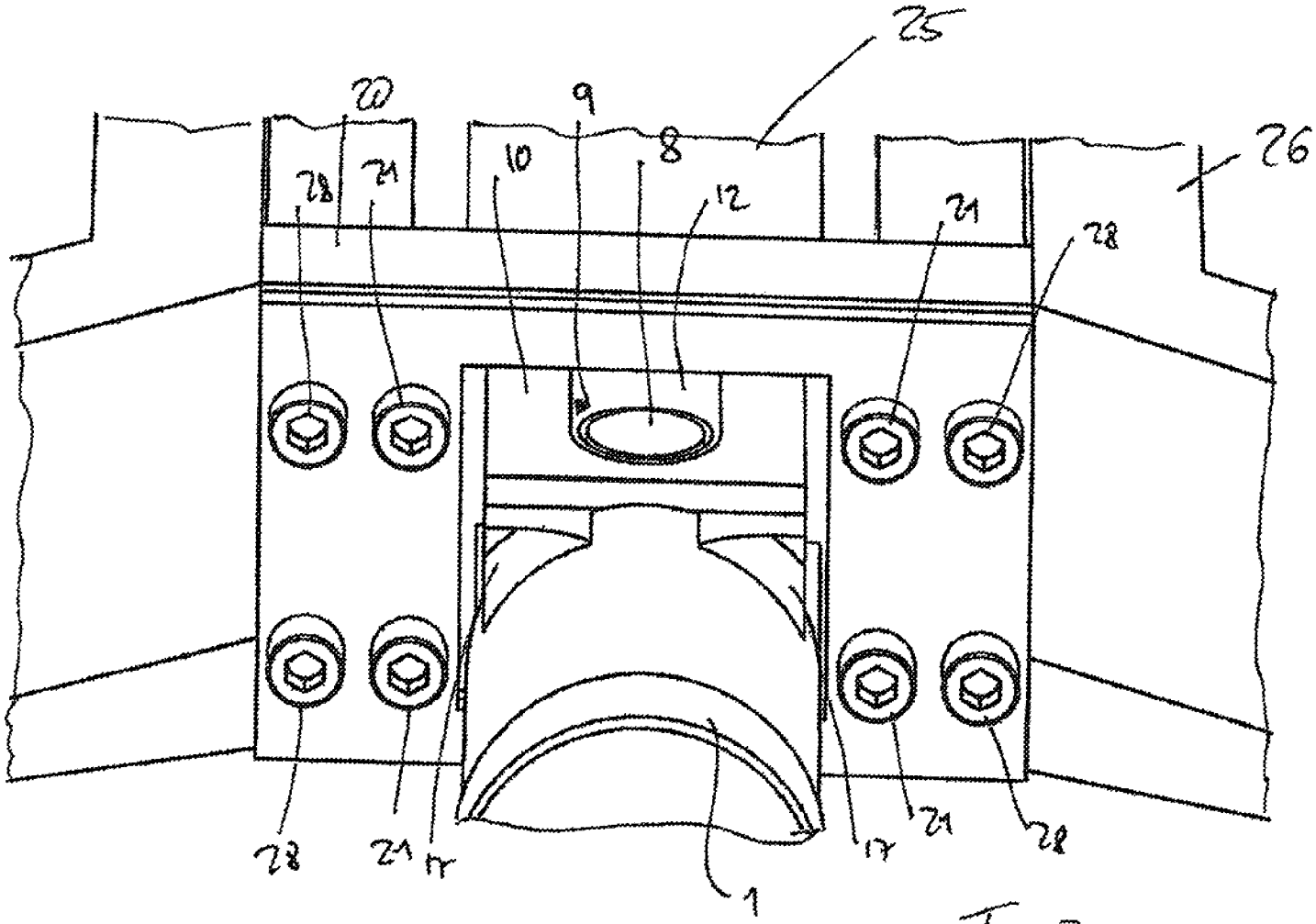
FIG. 7*a, b* a perspective view onto the assembly according to the invention that forms part of the system according to the invention as shown in FIG. 6 in two different operational stages.
Figure 8:
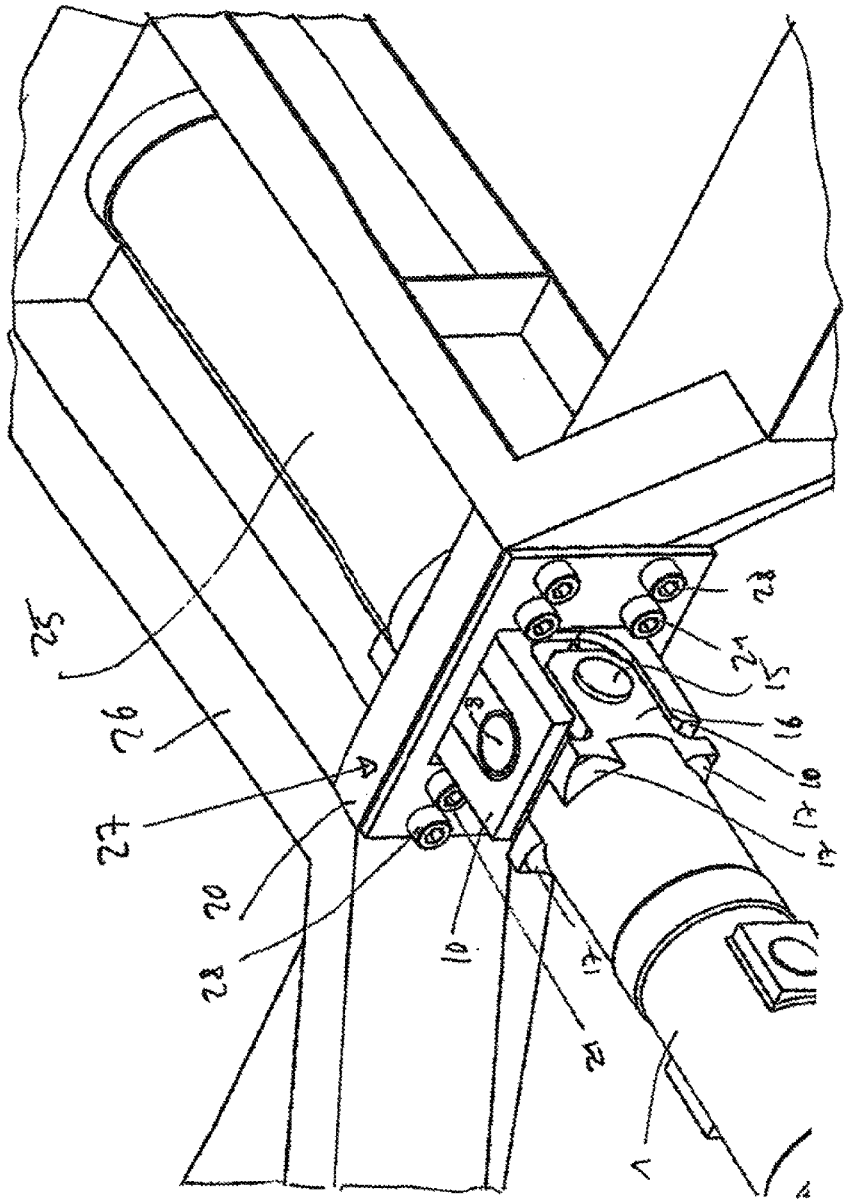
FIG. 8 a perspective view of the system according to the invention as shown in FIG. 6 in a normal operational mode, FIG. 9 a system according to the invention as shown in FIG. 6 in a perspective view with the energy-absorbing deformation element having been deformed due to a crash.
Figure 9:
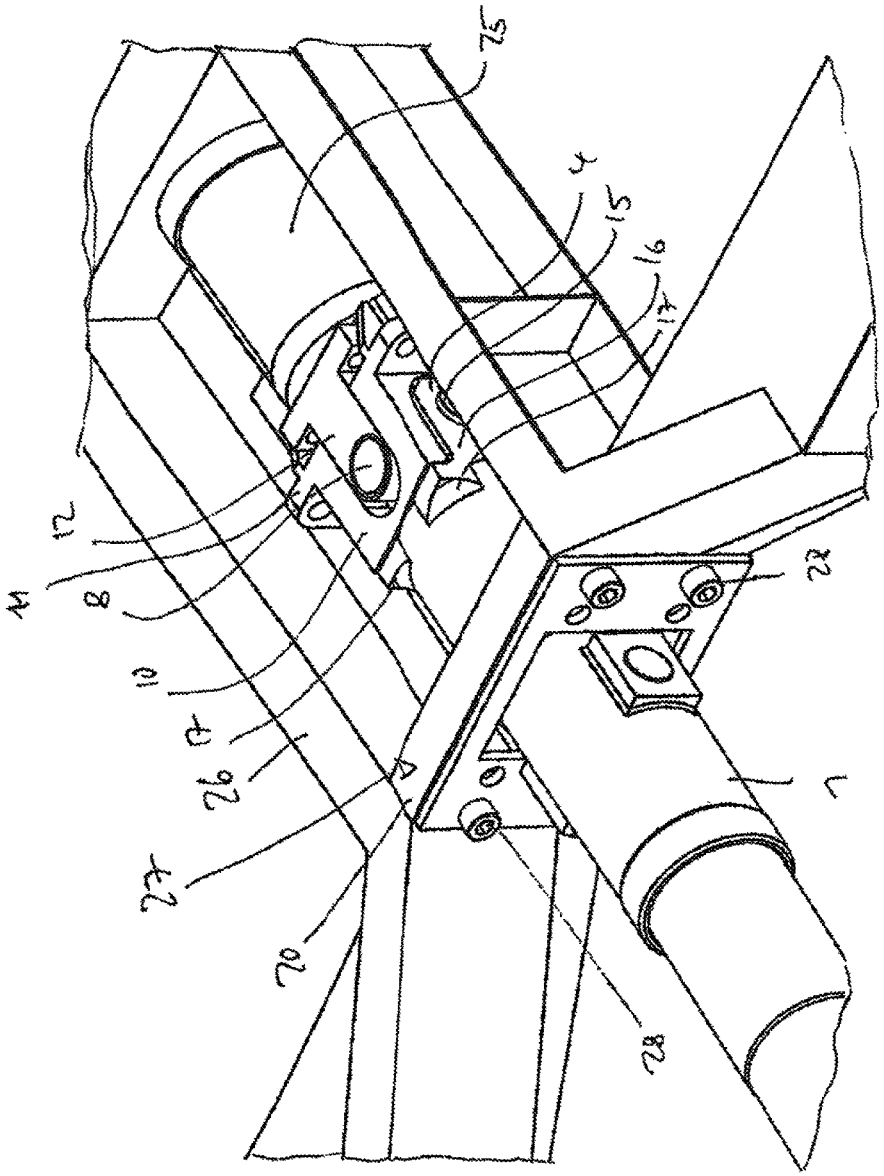

In FIGS. 1 to 4, the parts of the bearing bracket according to the invention and the assembly according to the invention are shown that can be used to implement the first shear-off step according to the invention. Especially FIGS. 7*a, b*, FIG. 8 and FIG. 9 show, how the second shear-off step according to the invention can be best realized.

FIGS. 1 to 4 show a connection rod 1 that extends between a first assembly of a bearing bracket (of which only parts are shown in the FIGS. 1 to 4) 2 and a second assembly of a bearing bracket (of which only parts are shown in the FIGS. 1 to 4) 3 according to the invention. To complete the assemblies 2 and 3 shown in FIGS. 1 to 4, brackets suitable for being connected to the respective car will be added as they were shown in FIG. 7*a, b*, FIGS. 8 and 9.

Figure 1:
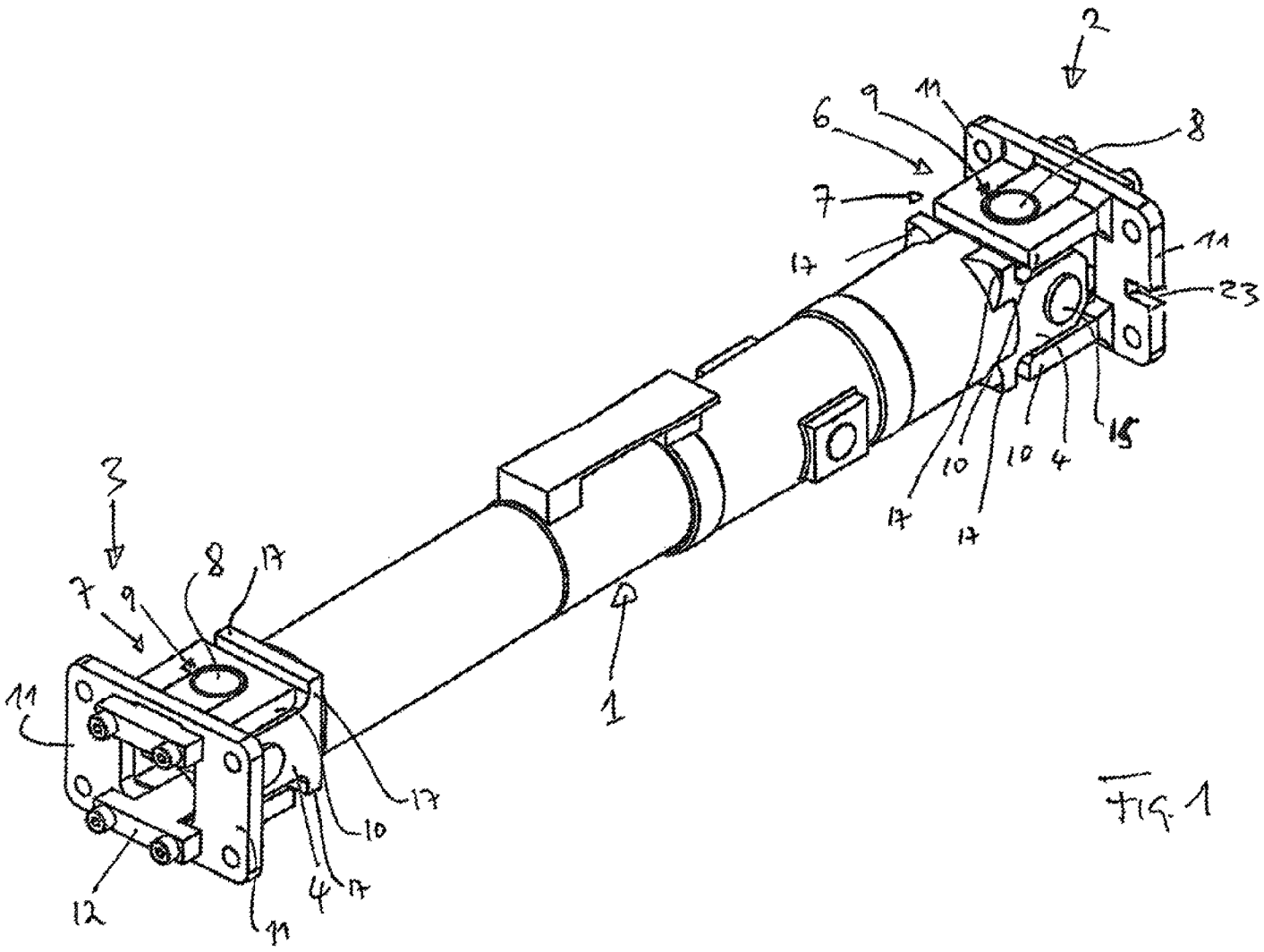
FIG. 1 a perspective view of a connection suitable to connect two cars of a multi-car vehicle, the connection shown making use of parts of the assembly of the invention and the bearing bracket of the invention.
Figure 2:
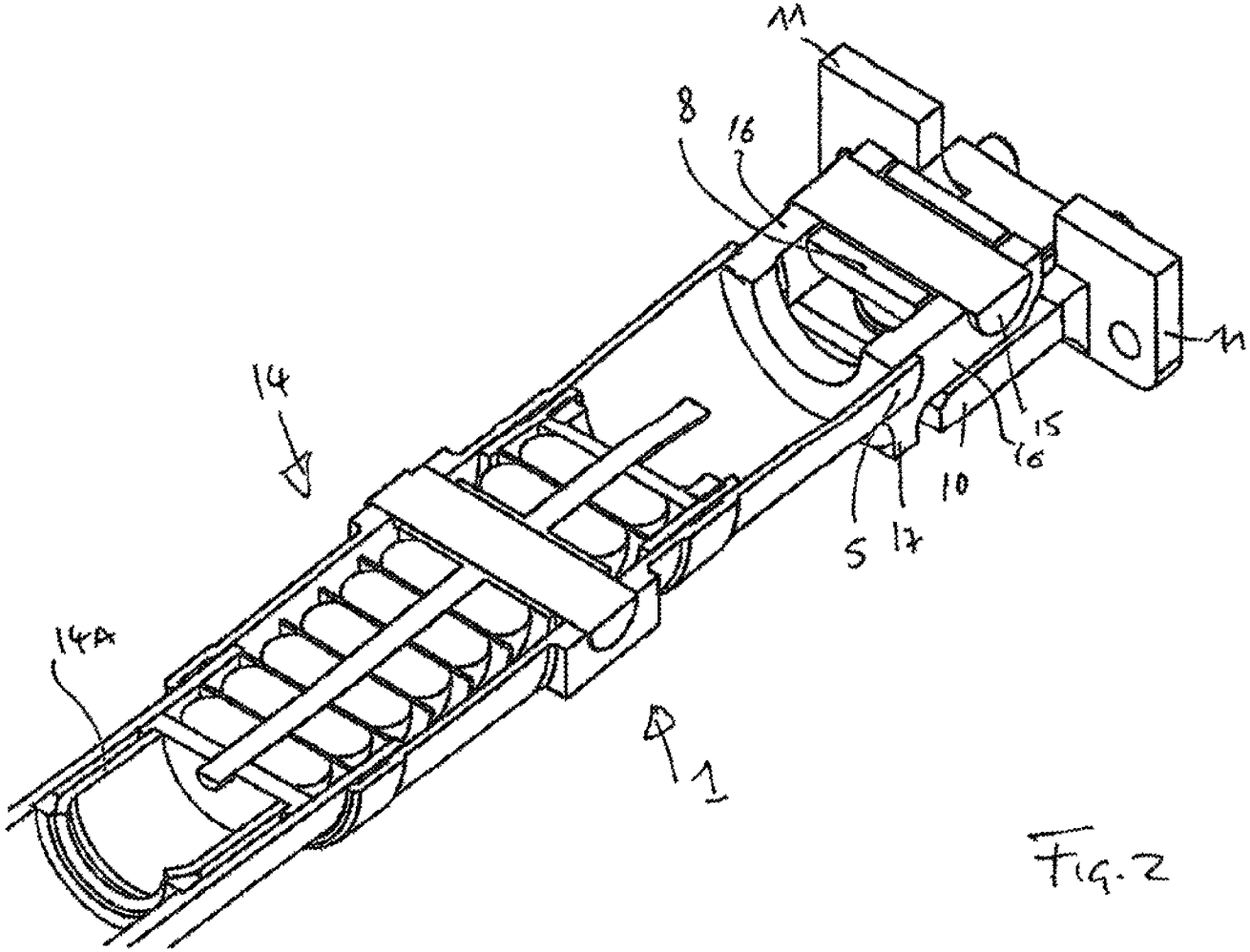
FIG. 2 a sectional view of a section of the connection of FIG. 1.

FIGS. 1 to 4 show an adapter 4 that is adapted such that the connection rod 1 can be connected to it. As best shown in FIG. 2, the adapter 4 has an end plate 5 arranged inside the connection rod that is partially hollow and has a cross section with the shape of a ring.

FIGS. 1 to 4 further show a joint 6 that is arranged in such a manner that it allows the adapter 4 to swivel relative to the bracket (not shown in FIGS. 1 to 4) about at least one swivel axis. In the embodiment shown, the adapter 4 can swivel about a vertical and a horizontal axis relative to the bracket.

The joint 6 connects the adapter 4 to a joint receiving part 7. The joint 6 has one joint pin 8 that extends vertically and is held at its upper end by an upper receptacle 9 of the joint receiving part. The vertically pin 8 is also held at its bottom end by a bottom receptacle of the joint receiving part 7 that is not shown in the views of FIGS. 1 to 4.

Figure 3:
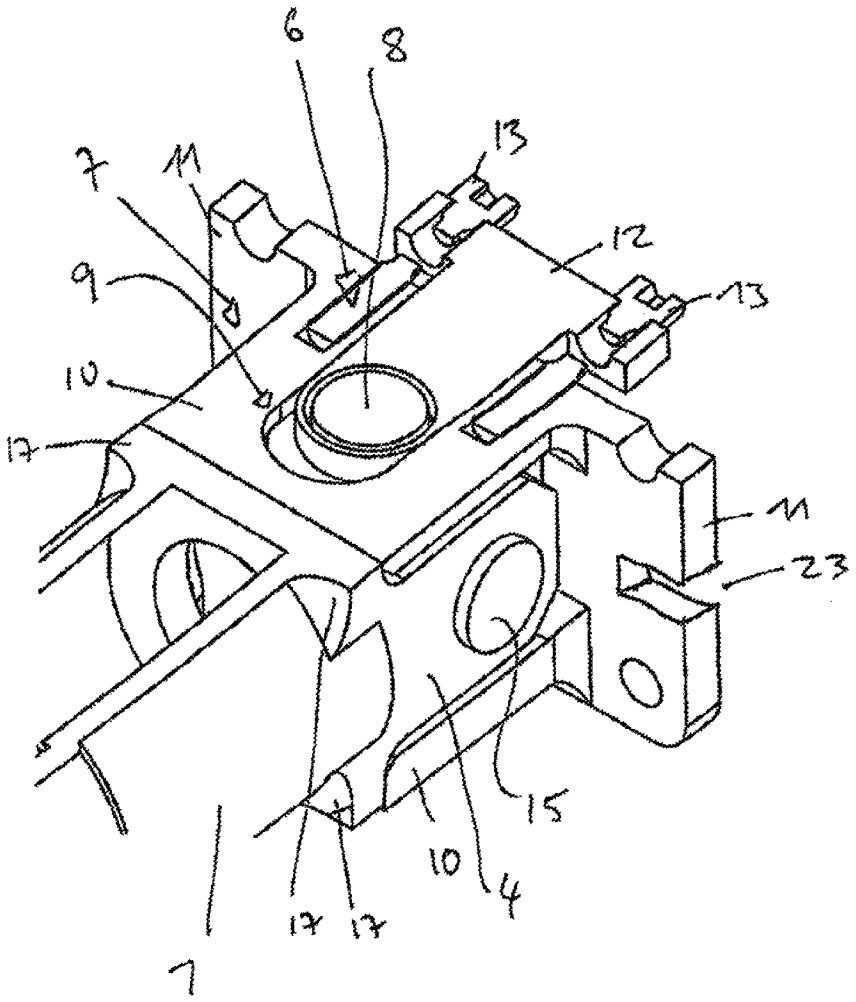
FIG. 3 a partial sectional view of parts of the assembly according to the invention as used in the connection of FIG. 1 in the operational state where the adapter is set free to move relative to at least some parts of the joint receiving part.
Figure 4:
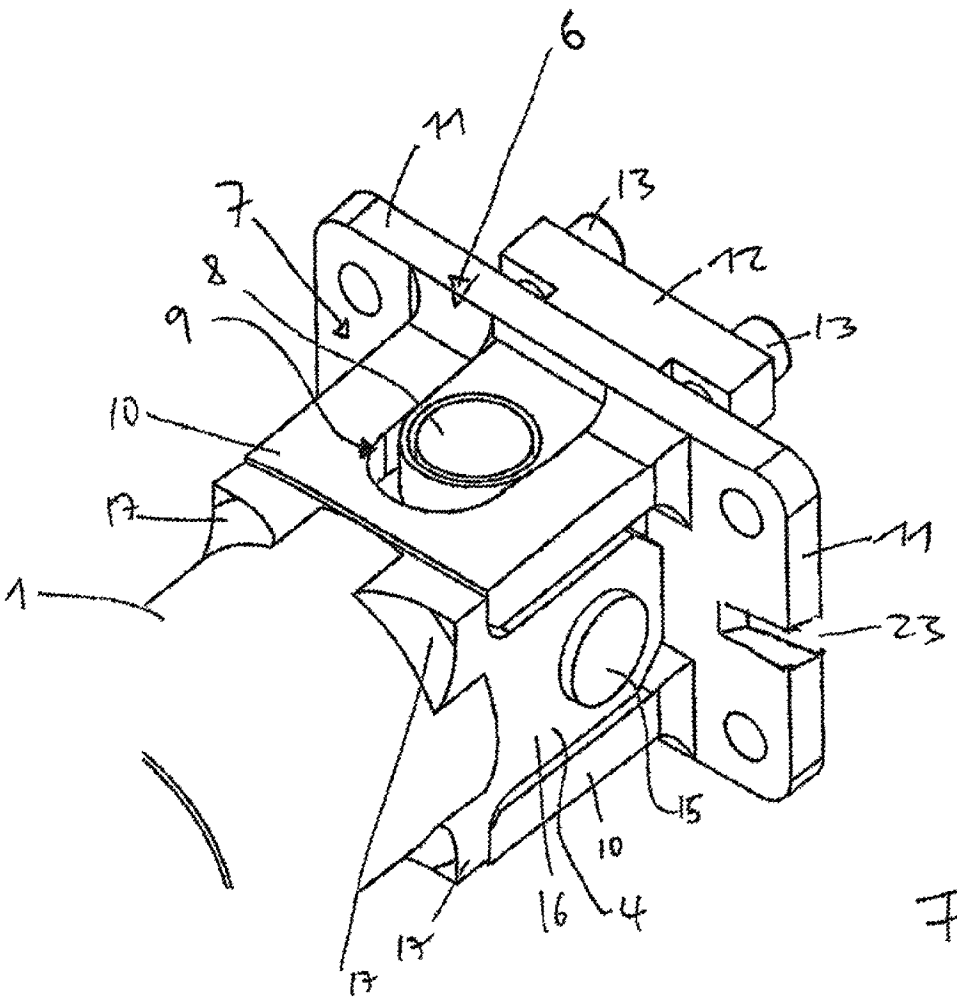
FIG. 4 the parts of the assembly according to the invention of FIG. 3 in a non-sectional view in the operational state where the adapter is set free to move relative to at least some parts of the joint receiving part.

The receptacle 9 is provided by two parts of the joint receiving part 7. Each of the two parts forms a part of the wall that delimits the receptacle 9. The one of the two parts, namely the part 10 for a part of its extent has the shape of a horseshoe. At the end of the horseshoe vertically extending flanges 11 are provided. The other of the two parts, namely part 12 is connected to the part 11 by means of four shear-off bolts. The two parts 10, 12 are thus connected to each other by a connection that upon application of a force of a predetermined strength can shear-off. FIG. 1 shows the two parts 10, 12 in the connected stage. Especially FIGS. 3 and 4 show, how the two parts 10, 12 are disconnected, once the shear-off bolts 13 shear off.

Figure 10:
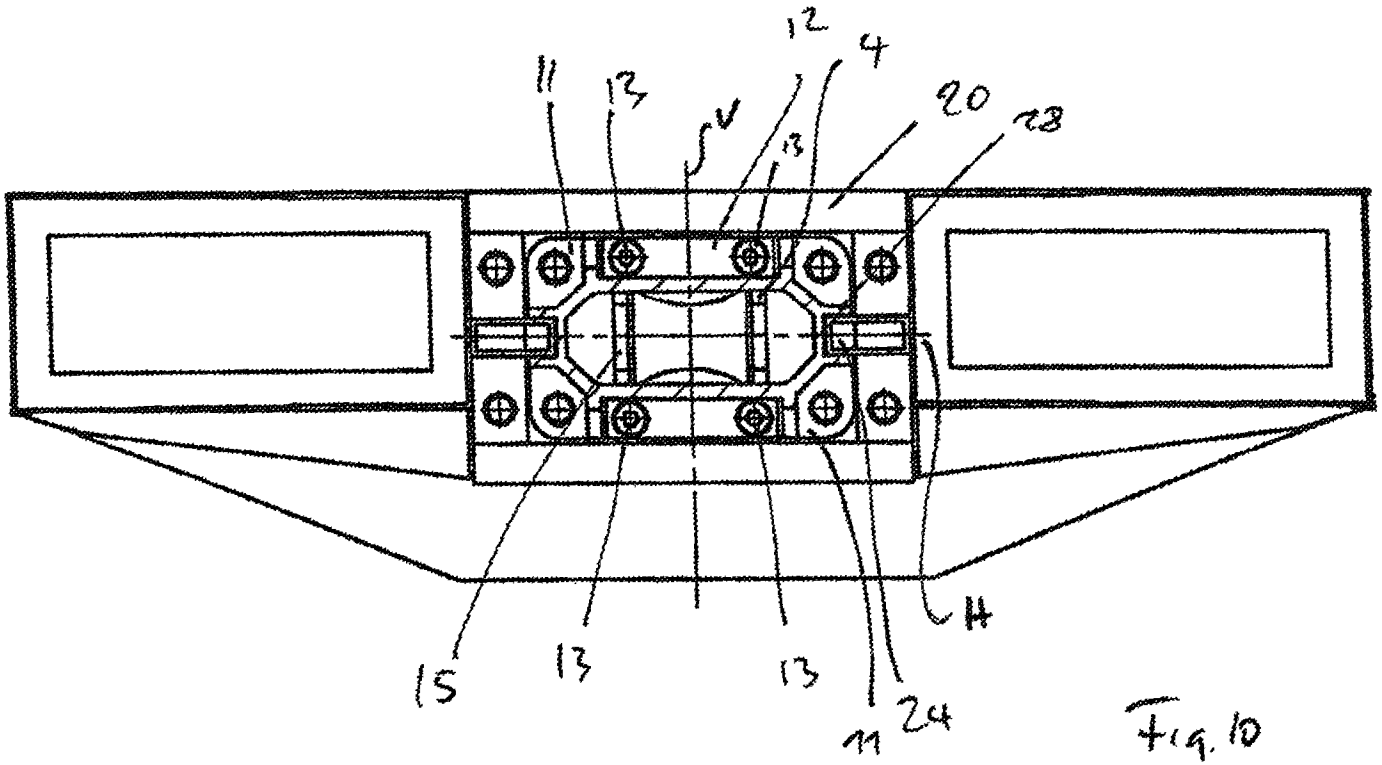
FIG. 10 a view from the back onto the joint receiving part, its flanges and the bracket of the bearing bracket, the bracket being formed as part of the underframe of the car and FIG. 11 a partially sectional, perspective view of parts of the rod, the bearing bracket, the underframe of the car and the deformation tube arranged inbetween the underframe of the car.

Making use of the two parts 10, 12 that provide the receptacle 9 allows for the joint 6 to connect the adapter 4 to the joint receiving part 7 in such a manner that the adapter 4 is set free to move relative to at least some parts (namely the part 10) of the joint receiving part 7 in the direction of the longitudinal axis of the connection rod 1, if a pushing force of the predetermined strength that is sufficient to have the shear-off bolts 13 shear off is applied to the adapter 4, the pushing force pointing into the direction of the longitudinal axis of the connection rod 1. FIG. 10 shows the symmetrical arrangement of the four shear-off bolts 13. In each of the quadrants delimited by the horizontal plane H that contains the longitudinal axis of the connection rod and the vertical plane V that contains the longitudinal axis of the connection rod 1 one of the four shear-off bolts 13 is arranged.

FIG. 2 shows that inside the connection rod 1, a damping element 14 is arranged such as to dampen the transmission of impacts along the longitudinal axis of the connection rod 1. The damping elements 14 are donut-shaped rubber elements. A group of these damping elements is arranged on one side of a connection element, such as to take up draft loads applied to the connection rod 1. A further group of damping elements is arranged on a further side of a connection element such as to take up buff loads applied to the connection rod. Furthermore, a deformation tube 14*a* is arranged inside the connection rod 1. The bearing bracket according to the invention especially the joint of the bearing bracket and the joint receiving part of the bearing bracket do not contain any damping elements that are arranged such as to dampen the transmissions of impacts of impacts from the adapter to the bracket. The shear-off bolts 14 that are provided as part of the bearing bracket according to the invention are not considered as damping elements that are arranged to dampen the transmissions of impacts from the adapter to the bracket, because shear-off bolts do not provide any substantial damping, but are of brittle material.

The joint 6 has the vertically extending joint pin 8 that is connected to the joint receiving part 7 and has a horizontally extending joint pin 15 that is connected to the vertically extending joint pin 8 and to the adapter 4. Making use of the vertically extending joint pin 8 and the horizontally extending joint pin 15 makes the joint 6 into a cardan joint. This allows the connection rod 1 to swivel relative to the joint receiving part 7 about a horizontal and a vertical axis.

The horseshoe-shaped part 10 of the joint receiving part 7 has guides (not shown) that guide the movement of the second part 12 such that the part 12 moves in a linear movement relative to the guiding part of part 10.

As can be seen from the FIGS. 1 to 4, the adapter 4 is formed by two parallel extending, spaced-apart, plate-like sections 16 that are connected to the connection rod 1. Each of the two plate-like sections 16 contains a hole to receive the opposite ends of the horizontally extending pin 15.

FIGS. 1 to 4 show that four elements 17 are arranged on the connection rod 1 and the four elements 17 have a cross section that is substantially shaped like a triangle. The elements 17 each have a vertically extending surface that thus extends in a plane at an angle of 90° relative to the horizontal longitudinal axis of the connection rod 1. These four surfaces are each arranged spaced-apart from respective vertically extending surfaces on the horseshoe-shaped part 10 of the joint receiving part 7, if the assembly of parts according to the invention is in a normal operational state. This state is shown in FIG. 1. The surfaces of the four elements 17 are held distanced from respective vertically extending surfaces on the horseshoe-shaped part 10 until a pushing force of a predetermined strength is applied to the connection between a first element, namely the part 12, and a second element, namely the horseshoe-shaped part 10, of the elements in the line of flow of force for transmitting forces acting along the longitudinal axis of the coupler rod or the connection rod 1 to the bracket 20 that brakes the connection (shears off the shear-off bolt 13) and sets the part 12 free to move relative to at horseshoe-shaped part 10, which movement allows the surface of the rod 1 to come into contact with the surface of the bearing bracket Once the adapter 4 is set free to move relative to the joint receiving part 7, if a pushing force of a predetermined strength is applied to the adapter 4 and the shear-off bolts 13 shear off, the four surfaces of the elements 17 move in the direction that the pushing force is pointing and come into contact with the vertically extending surface on the horseshoe-shaped part 10 of the joint receiving part 7. The four surfaces of the elements 17 are arranged in the same vertical plane, whereby in each of the quadrants delimited by the horizontal plane that contains the longitudinal axis of the connection rod and the vertical plane that contains the longitudinal axis of the connection rod 1 one of the four surfaces is arranged.

Figure 5A:
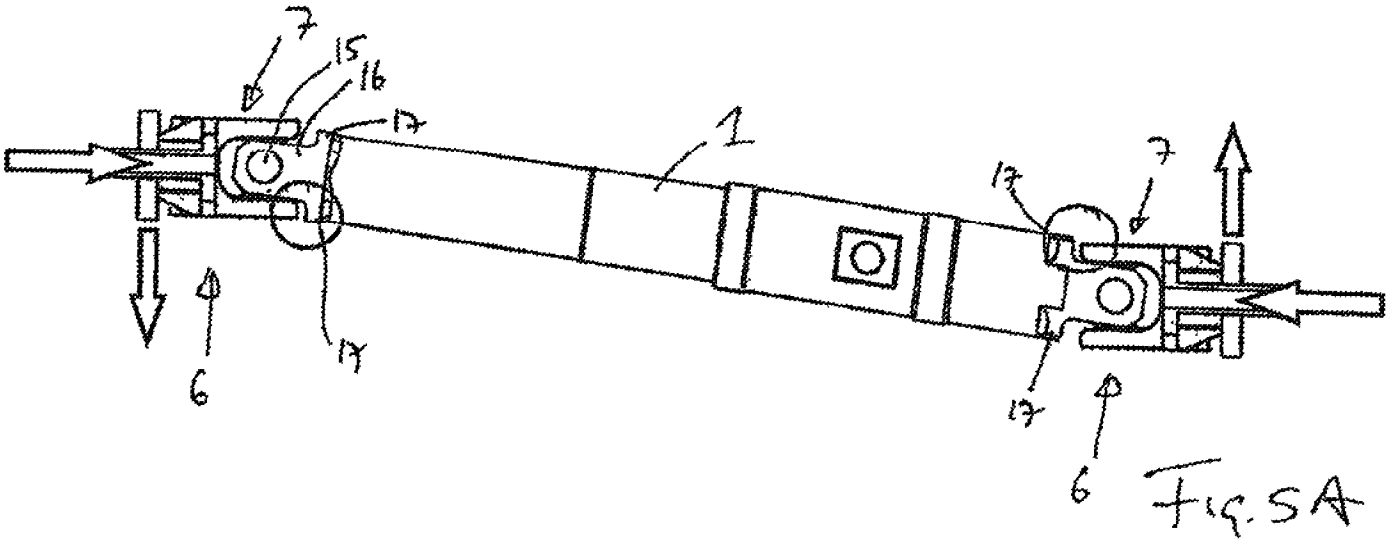
FIG. 5*a*, 5*b* schematic illustrations of the stabilizing forces provided by the assembly according to the invention.
Figure 5B:
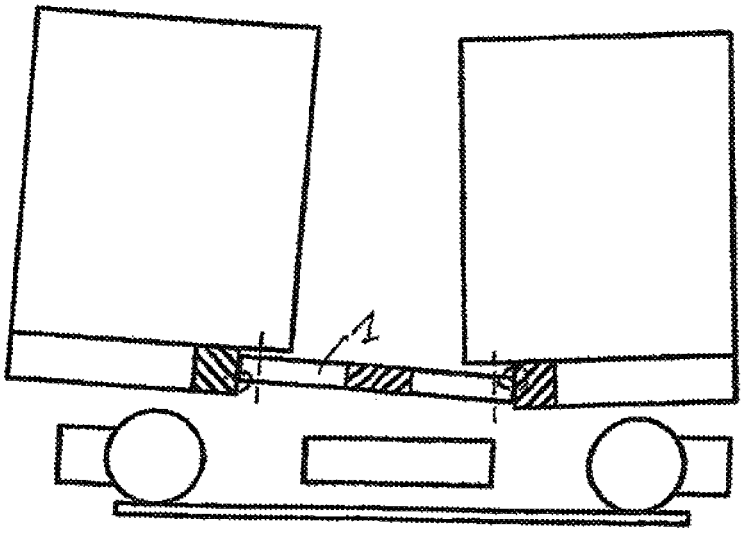

FIG. 1 in comparison to FIGS. 2, 3, and 4 shows a different operational stage of the assembly according to the invention. FIG. 1 shows the normal operational stage, where the shear-off bolts 13 have not sheared off and wherein the surfaces of the elements 17 are distanced from the vertical surface on the part 10 of the joint receiving part 7. If a pushing force of a predetermined strength is applied to the adapter 4 that points along the longitudinal axis of the adapter 4, this force is passed via the adapter 4 and the joint 6 into the joint receiving part 7 and pushes the part 12 of the joint receiving part 7 away from the horseshoe-shaped part 10 of the joint receiving part. If this pushing force reaches a predetermined level, the shear-off bolts 13 will shear off and thereby set the part 12 to move relative to the part 10. Given that the adapter 4 and thus the connection rod 1 as well as the elements 17 are connected to the part 12 of the joint receiving part 7 via the joint 6, the adapter 4, the connection rod 1 and the elements 17 are set free to travel relative to part 10 of the joint receiving part 7. This will lead to the above discussed vertical surfaces of the elements 17 to come into contact with the vertical surface on the part 10 of the joint receiving part 7. If the connection rod 1 points at an angle to the horizontal plane as shown in FIG. 5*a* and FIG. 5*b* in such a situation, the vertical surfaces of the elements 17 arranged on the top of the connection rod 1 on the one side of the connection rod 1 will start to come into contact with the vertical surface of the horseshoe-shaped part 10 facing them. This is highlighted in FIG. 5 *a* by a circle. Likewise at the other end (left-hand side in FIG. 5*a*) the vertical surfaces of the lower elements 17 start to come into contact with the vertical surfaces on the horseshoe-shaped part 10 of the joint receiving part 7. This is also highlighted by a circle in FIG. 5*a*. The continuous application of the force and the contact between surfaces of the connection rod and the joint receiving part only on one side of the horizontal plane at the respective end of the connection rod 1 lead to a stabilizing force drawn into FIG. 5*a* that points into the direction necessary to move the connection rod 1 back into the horizontal plane.

FIGS. 6 to 9 show that the bearing bracket according to the invention has a bracket 20 that forms part of the car. The flanges 11 are connected to the bracket 20 by means of four shear-off bolts 21. The flanges 11 being part of the joint receiving part 7 lead to the joint receiving part 7 being connected to the bracket 20 in such a manner that the joint receiving part 7 is set free to move relative to the bracket 20, if a pushing force of a predetermined strength is applied to the joint receiving part pointing into the direction that leads the shear-off bolts 21 to shear off. As can be seen from FIGS. 7*a* and *b*, the four shear-off bolts 21 are arranged at the same distance to the vertical plane that contains the longitudinal axis and are arranged at the same distance to the horizontal plane that contains the longitudinal axis of the connection rod 1.

Figure 7B:
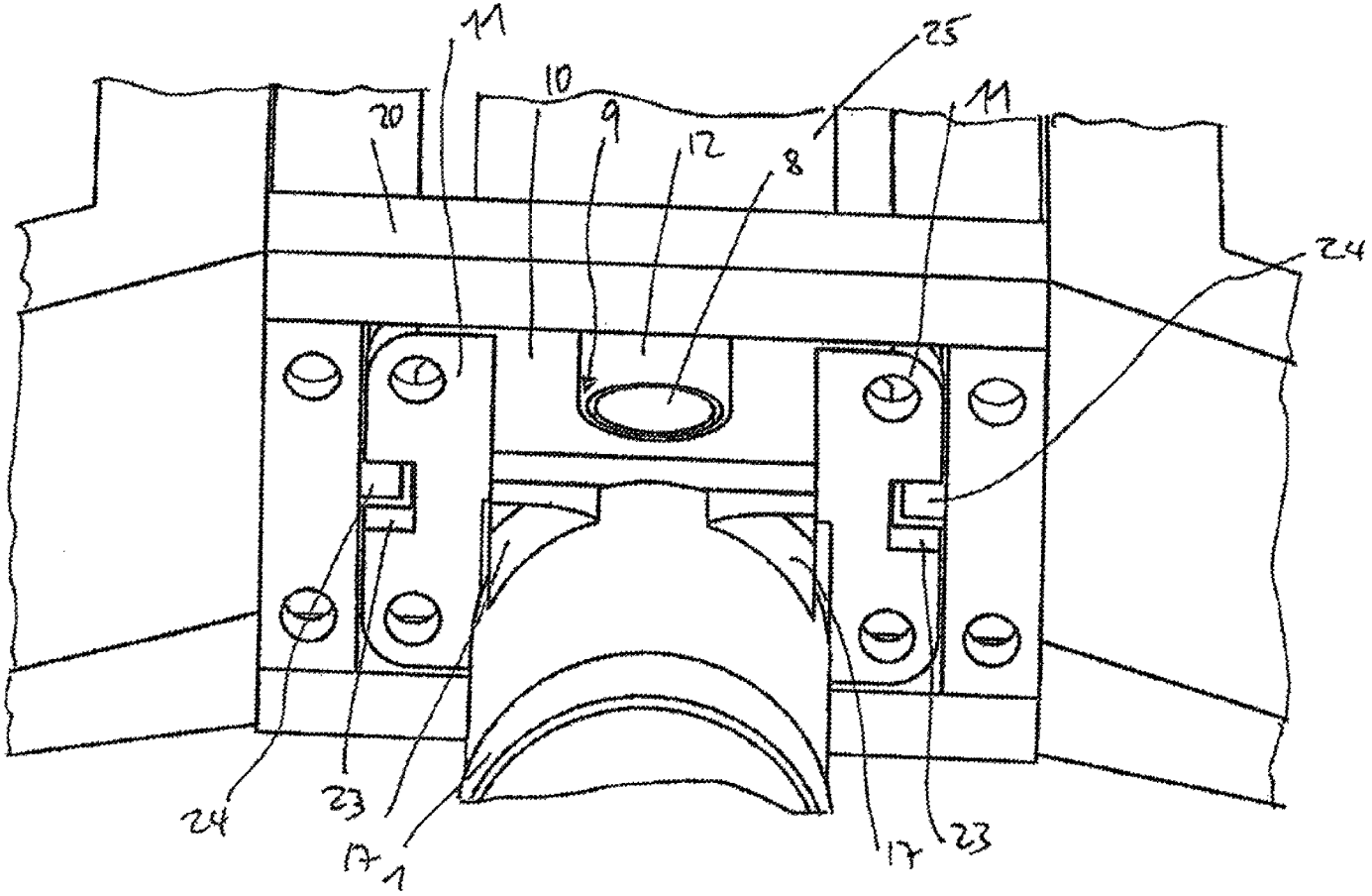

As can be seen in FIG. 7*b*, a hole 22 (fully taken up by the joint receiving part 7 in FIG. 7*b*) is formed by the bracket 20. Through the hole 22 the joint bearing part 7 can move, if it is set free to move relative to the bracket 20. To assist the movement of the joint bearing part 7, the joint bearing part 7 has two vertically extending flanges 11 that each have a horizontally extending cut-out 23 that engages with respective one of two guide-bars 24 that are arranged facing inward into the hole 22 in the bracket 20. As can be seen from FIG. 7*b*, the recesses 23 on the two vertically extending flanges 11 and the two guide-bars 24 are arranged in such a manner that they can take up a momentum around a horizontal axis perpendicular to the longitudinal axis of the connection rod 1. The interaction between the recesses and the guide-bars will thus lead to the joint receiving part 7 being guided to move along a horizontal line.

FIGS. 6 to 9 show that an energy-adsorbing deformation element in the form of a deformation tube 25 is arranged behind the bearing bracket and in between beams of the underframe of the multi-car vehicle. FIGS. 8 and 9 show that the energy-adsorbing deformation element 25 is deformed by the movement of the joint receiving part 7. The use of the interaction between the guide-bars 24 and the cut-outs 23 on the flanges 11 of the joint receiving part 7 leads to the situation that only a force pointing in the longitudinal direction is applied to the energy-adsorbing deformation element 25 in the crash condition. This leads to an advantageous deformation of the energy-adsorbing deformation element 25. As can be best seen in FIGS. 8 and 9, the underframe 26 has a clearance 27 taken up by the bearing bracket according to the invention. The connection rod 1 moves through the clearance 27 once the joint receiving part 7 is set free to move relative to the bracket 20.

As can be seen from FIG. 7*a*, a plate 30 is provided that is connected to the bracket 20 by means of four bolts 28 and is connected to the flange 11 by the four shear-off bolts 21.

The shape of the underframe 26 that in the area of the assembly according to the invention has a U-shaped section that surrounds the energy-adsorbing deformation element 25 leads to the advantageous situation that the energy-adsorbing deformation element 25 can be attached to the underframe 26 to take up forces which have been introduced into the energy-absorbing deformation element 25 by the joint receiving part 7 and to redirect these forces back towards an area of the car, where the clearance 27 is arranged. If the underframe 26 of the car has longitudinal beams that are intended to transmit longitudinal forces along the car and if these beams are placed further away from the assembly according to the invention, redirecting the forces back towards an area of the car where the clearance 27 is arranged, allows for these forces to then be introduced into the longitudinal beams of the underframe that transmit these forces further along the car.

Figure 11:
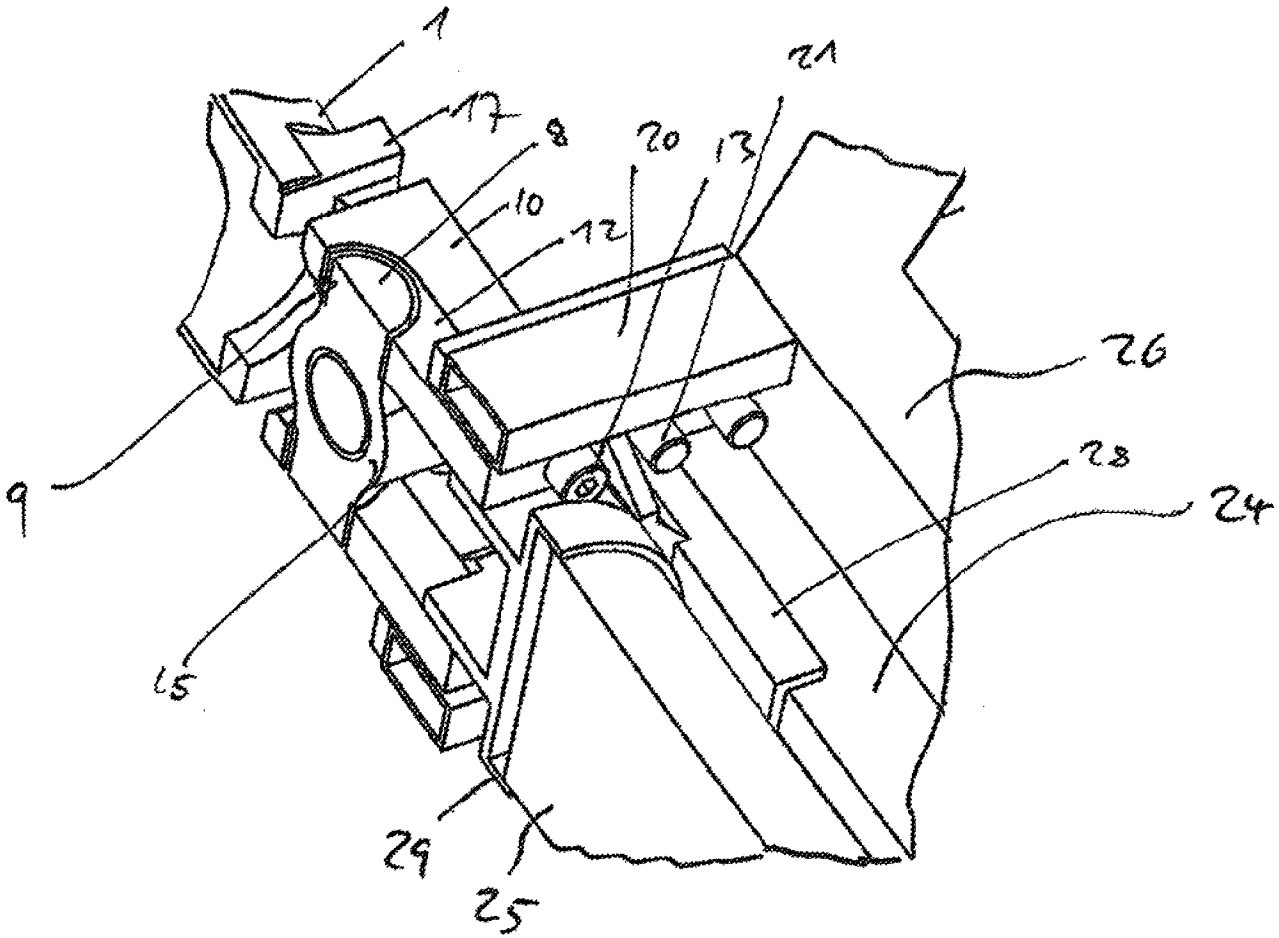

FIG. 11 shows that the guide-bars 24 continue behind the bearing bracket and are attached to parts of the underframe 26. A claw-like element 28 continues the cut-out 23 provided in the flanges 11. Because of the longitudinal extend of the claw-like elements 28 it can take up a momentum around a horizontal axis perpendicular to the longitudinal axis of the rod very well. This leads to a second stabilizing function.

Figure 6:
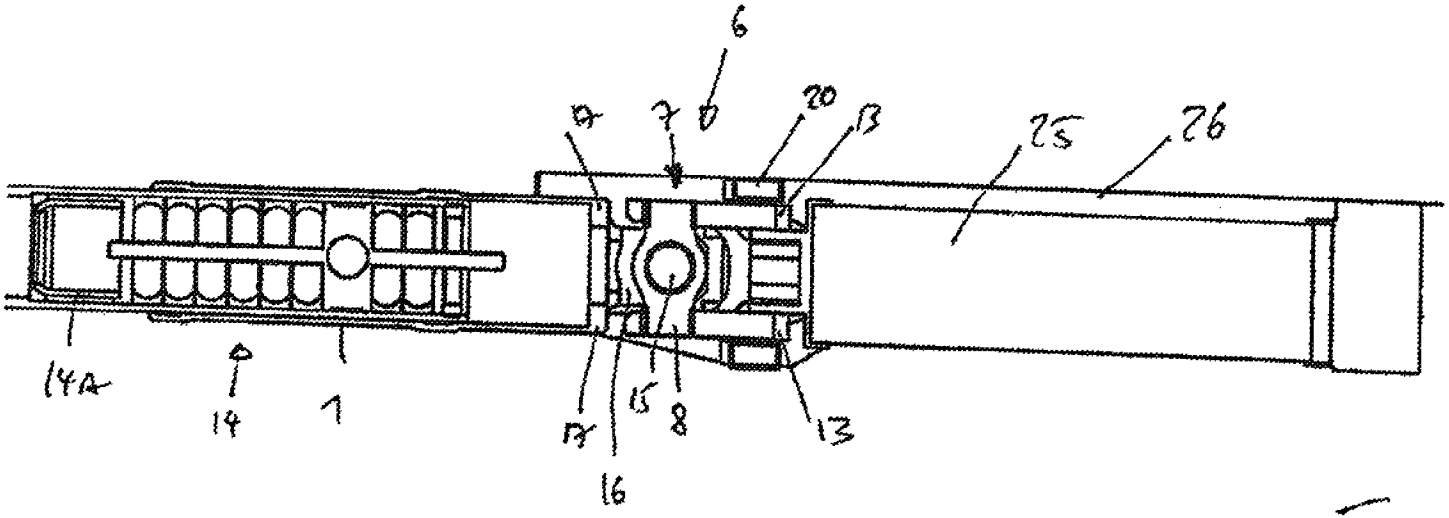
FIG. 6 a sectional view of the system according to the invention.

FIG. 11 also shows that the deformation tube 25 is held in a bush that is fixedly connected to the second part 12. As can be seen in FIG. 11 that shows a operation condition during normal travel, the end of the deformation tube is at a distance to the bottom of the bush. Once the shear off bolts 13 shear off, the second part 12 will move relative to the horse-shoe shaped first part 10. This movement will start to close the gap between the bottom of the bush and the end of the deformation tube. The gap will be fully closed, once the shear off bolts 21 shear off. As an alternative, the gap can be provided on the other side of the deformation tube as shown in FIG. 6. In FIG. 6 the one end of the deformation tube is in contact with the bottom of the bush 29, but a gap is provided at the opposite end of the deformation tube between this opposite end of the deformation tube and a counter wall. Providing gaps allows for a secure shear off of the bolts 13 and 21 that will stretch a little before they shear off.

The invention claimed is:

1. An assembly with a bearing bracket and a rod, the bearing bracket comprising:

an adapter that is adapted such that the rod can be connected to it, a bracket, wherein the bracket is one of a bracket for forming part of a car and a bracket configured for connection to a car of a multi-car vehicle, a joint arranged in such manner that it allows the adapter to swivel relative to the bracket about at least one swivel axis, whereby the rod is attached to the adapter or is formed as one piece with the adapter and wherein the rod has at least one surface that extends in a plane that is at an angle relative to the longitudinal axis of the rod and wherein the at least one surface of the rod is:

held spaced apart from a surface of the bearing bracket by an elastic element arranged between a first element and a second element of elements in the line of flow of force for transmitting forces acting along the longitudinal axis of the rod to the bracket that by its resilience keeps the first element spaced apart from the second element and whereby the surface of the rod comes into contact with the surface of the bearing bracket when a pushing force of a first predetermined strength is applied to the rod that overcomes at least a part of the resilience of the elastic element; and wherein a group of parts of the bearing bracket, including at least the adapter and the joint, are connected to the bracket by at least one connection element adapted to shear off responsive to a pushing force of a second predetermined strength in such a manner that the group of parts is set free to move longitudinally relative to the bracket when the pushing force of the second predetermined strength is applied to the rod;

wherein the rod is one of a coupler rod and a connection rod.

2. The assembly according to claim 1, further comprising an energy absorbing element that is deformed by the movement of a part of the group of parts set free to move longitudinally relative to the bracket when the pushing force of the second predetermined strength is applied to the rod.

3. The assembly according to claim 1, wherein the surface that extends at an angle relative to the longitudinal axis of the rod is arranged above and/or below the horizontal plane that contains the longitudinal axis of the rod and/or left or right of the vertical plane that contains the longitudinal axis of the rod.

4. The assembly according to claim 1, wherein a part of the group of parts set free to move longitudinally relative to the bracket has a cut-out that engages with a guide-bar that guides the movement of that part.

5. A bearing bracket for connecting a rod to a car, comprising:

an adapter that is adapted such that the rod can be connected to it, a bracket forming part of a car or being a bracket suitable for being connected to a car of a multi-car vehicle, a joint arranged in such manner it allows the adapter to swivel relative to the bracket about at least one swivel axis, wherein the joint connects the adapter to a joint receiving part in such a manner that the adapter is set free to move relative to at least some parts of the joint receiving part in at least one direction when a pushing force of a first predetermined strength is applied to the adapter that points into this at least one direction, and wherein the joint receiving part is connected to the bracket by at least one connection element adapted to shear off responsive to a pushing force of a second predetermined strength in such a manner that the joint receiving part is set free to move longitudinally relative to the bracket when the pushing force of the second predetermined strength greater than the first predetermined strength is applied to the joint receiving part; and wherein the rod is one of a coupler rod and a connection rod.

6. The bearing bracket according to claim 5, wherein the joint has at least one joint pin that is partially held in a receptacle of the joint receiving part, wherein the receptacle is provided by at least two parts of the joint receiving part, each of the at least two parts forming a part of a wall that delimits the receptacle, wherein the two parts are connected to each other by the at least one connection element that upon application of the force of the second predetermined strength can shear off.

7. The bearing bracket according to claim 5, wherein the joint receiving part has at least one flange that is connected to the bracket by the at least one connection element that upon application of the force of the second predetermined strength can shear off.

8. The bearing bracket according to claim 5, wherein the joint has a vertically extending joint pin that is connected to the joint receiving part and has a horizontally extending joint pin that is connected to the vertically extending joint pin and to the adapter.

9. The bearing bracket according to claim 5, wherein the joint receiving part has at least two vertically extending flanges and whereby the two vertically extending flanges each have a horizontally extending cut-out that engages with the respective one of two guide-bar that are arranged facing inward into a hole formed in the bracket, through which hole the joint receiving part can move once it is set free to move longitudinally relative to the bracket, when the pushing force of the second predetermined strength is applied to the joint receiving part.

10. The bearing bracket according to claim 9, whereby the cut-outs on the two vertically extending flanges and the two guide bars are arranged in such a manner that they can take up a momentum around a horizontal axis perpendicular to the longitudinal axis of the rod.

11. The bearing bracket according to claim 5, further comprising an elastic element which connects the adapter to the joint receiving part in such a manner that the adapter is set free to move relative to at least some parts of the joint receiving part in at least one direction when the pushing force of the first predetermined strength is applied to the adapter that points into this at least one direction to overcome at least a part of a resilience of the elastic element.

12. The bearing bracket according to claim 5, further comprising at least one first connection element which connects the adapter to the joint receiving part in such a manner that the adapter is set free to move relative to at least some parts of the joint receiving part in at least one direction when the pushing force of the first predetermined strength is applied to the adapter that points into this at least one direction to break the at least one first connection element.

13. An assembly, comprising:

a bearing bracket for connecting one of a coupler rod and a connection rod to a car, comprising an adapter that is adapted such that the rod can be connected to it, a bracket, the bracket either (a) forming part of a car or (b) being suitable for being connected to a car of a multi-car vehicle, a joint arranged to allow the adapter to swivel relative to the bracket about at least one swivel axis, wherein the joint connects the adapter to a joint receiving part in such a manner that the adapter is set free to move relative to at least some parts of the joint receiving part in at least one direction when a pushing force of a first predetermined strength is applied to the adapter that points into this at least one direction, and wherein the joint receiving part is connected to the bracket by at least one connection element adapted to shear off responsive to a pushing force of a second predetermined strength in such a manner that the joint receiving part is set free to move longitudinally relative to the bracket when the pushing force of the second predetermined strength greater than the first predetermined strength is applied to the joint receiving part; and the rod attached to the adapter;

wherein the rod is one of a coupler rod and a connection rod.

14. The assembly according to claim 13, wherein the adapter is formed as one piece with parts of the rod.

15. The assembly according to claim 13, wherein at least one of a rubber draft gear and a destructive energy absorbing element is arranged as part of the rod.

16. The assembly according to claim 13, further comprising an elastic element which connects the adapter to the joint receiving part in such a manner that the adapter is set free to move relative to at least some parts of the joint receiving part in at least one direction when the pushing force of the first predetermined strength is applied to the adapter that points into the at least one direction to overcome at least a part of a resilience of the elastic element.

17. The assembly according to claim 13, further comprising at least one first connection element which connects the adapter to the joint receiving part in such a manner that the adapter is set free to move relative to at least some parts of the joint receiving part in at least one direction when the pushing force of the first predetermined strength is applied to the adapter that points into this at least one direction to break the at least one first connection element.

* * * * *